US007146761B2

(12) United States Patent
Milo

(10) Patent No.: US 7,146,761 B2
(45) Date of Patent: Dec. 12, 2006

(54) GUN BARREL SAFETY LOCK WITH HAND RATCHETING WRENCH

(75) Inventor: Thomas K. Milo, Akron, OH (US)

(73) Assignee: T.K.M. Unlimited, Inc., Akron, OH (US)

( * ) Notice: Subject to any disclaimer, the term of this patent is extended or adjusted under 35 U.S.C. 154(b) by 80 days.

(21) Appl. No.: 10/761,817

(22) Filed: Jan. 21, 2004

(65) Prior Publication Data

US 2004/0200114 A1 Oct. 14, 2004

Related U.S. Application Data

(63) Continuation-in-part of application No. 10/027,034, filed on Dec. 20, 2001, now Pat. No. 6,701,655.

(51) Int. Cl.
*F41A 17/44* (2006.01)

(52) U.S. Cl. ..... 42/70.11

(58) Field of Classification Search ..... 42/70.11, 42/95, 70.01
See application file for complete search history.

(56) References Cited

U.S. PATENT DOCUMENTS

| | | | | |
|---|---|---|---|---|
| 2,836,918 | A | 6/1958 | Pula et al. | |
| 2,870,794 | A | 1/1959 | Thaxton | |
| 2,937,666 | A | 5/1960 | Maisch | |
| 3,154,874 | A | 11/1964 | Stewart | 42/70.11 |
| 3,193,959 | A | 7/1965 | Jaycox | 42/70.11 |
| 4,266,814 | A | 5/1981 | Gallagher | |
| 4,282,982 | A | 8/1981 | Nuesslein | |
| 4,291,481 | A | 9/1981 | Hillberg | |
| 4,299,045 | A | 11/1981 | Cervantes | |
| 4,302,898 | A | 12/1981 | LaRue | |
| 4,306,487 | A | 12/1981 | Beretta | |
| 4,310,029 | A | 1/1982 | Dudek | |
| 4,381,800 | A | 5/1983 | Leslie | |
| 4,384,420 | A | 5/1983 | Von Muller | |
| 4,385,643 | A | 5/1983 | Noe | 73/49.5 |
| 4,398,366 | A | 8/1983 | Wernicki | |
| 4,412,397 | A | 11/1983 | Bayn | |
| 4,457,091 | A | 7/1984 | Wallerstein | |
| 4,461,108 | A | 7/1984 | Von Muller | |
| 4,462,179 | A | 7/1984 | Rogak et al. | |
| 4,479,320 | A | 10/1984 | Fix | |
| 4,499,681 | A | 2/1985 | Bako et al. | |
| 4,509,281 | A | 4/1985 | Dreiling et al. | |

(Continued)

OTHER PUBLICATIONS

Advertisement/Flyer entitled "Securitron Mortise UnLatch Motorized Electronic Strike"; By Securitron Magnalock Corporation, An ASSA ABLOY Group Company, 550 Vista Blvd., Sparks, NV 89434; Copyright 2001, #910-10115 Rev. A ;2 pages ; no date.

*Primary Examiner*—Stephen M. Johnson
(74) *Attorney, Agent, or Firm*—Fay, Sharpe, Fagan, Minnich & McKee, LLP

(57) ABSTRACT

A gun safety device includes a barrel plug assembly having a first compression member, a second compression member, an expansion member, a joining member, and an adjustable extension rod assembly. The expansion member is sandwiched between the first compression member and the second compression member. The joining member is operatively linking the first compression member to the second compression member. The joining member is adapted to draw at least one of the compression members towards the other compression member. The adjustable extension rod assembly extends from the second compression member.

31 Claims, 23 Drawing Sheets

U.S. PATENT DOCUMENTS

| | | | | |
|---|---|---|---|---|
| 4,512,099 | A | 4/1985 | Mathew | |
| 4,528,765 | A | 7/1985 | Johnson | |
| 4,532,729 | A | 8/1985 | Von Muller | 42/70.11 |
| 4,569,144 | A | 2/1986 | Thurber | 42/70.11 |
| 4,576,021 | A | 3/1986 | Holden | 70/34 |
| 4,600,036 | A * | 7/1986 | Noe | 138/89 |
| 4,654,992 | A | 4/1987 | Lavergne | 42/70.01 |
| 4,682,435 | A | 7/1987 | Heltzel | 42/66 |
| 4,761,906 | A | 8/1988 | Guevara | 42/70.11 |
| 4,763,431 | A | 8/1988 | Allan et al. | 42/70.11 |
| 4,776,123 | A | 10/1988 | Ascroft | 42/70.11 |
| 4,783,924 | A | 11/1988 | Thurber | 42/70.11 |
| 4,787,224 | A | 11/1988 | Mesa | 70/313 |
| 4,802,298 | A | 2/1989 | Baugus | 42/70.11 |
| 4,827,649 | A | 5/1989 | Sheehan | 42/70.11 |
| 4,908,971 | A | 3/1990 | Chaney | 42/70.11 |
| 4,965,952 | A | 10/1990 | Miller et al. | 42/70.01 |
| 4,969,284 | A | 11/1990 | Healey et al. | 42/70.11 |
| 4,987,693 | A | 1/1991 | Brooks | 42/70.11 |
| 4,999,940 | A | 3/1991 | Madden | 42/70.11 |
| 5,001,854 | A | 3/1991 | Derman | 42/70.11 |
| 5,014,457 | A | 5/1991 | Lewis et al. | 42/70.11 |
| 5,016,377 | A | 5/1991 | Gunning | 42/70.11 |
| 5,038,508 | A | 8/1991 | Brown | 42/70.11 |
| 5,044,105 | A | 9/1991 | Lindley et al. | 42/70.11 |
| 5,044,106 | A | 9/1991 | Slocum | 42/70.11 |
| 5,048,211 | A | 9/1991 | Hepp | |
| 5,052,142 | A | 10/1991 | Mikus | 42/70.11 |
| 5,054,223 | A | 10/1991 | Lee | 42/70.11 |
| 5,062,233 | A | 11/1991 | Brown | 42/70.11 |
| 5,070,635 | A | 12/1991 | Cvetanovich | |
| 5,115,589 | A | 5/1992 | Shuker | 42/70.11 |
| 5,138,785 | A | 8/1992 | Paterson | 42/66 |
| 5,140,766 | A | 8/1992 | Brooks | 42/70.11 |
| 5,171,924 | A | 12/1992 | Honey et al. | 42/70.11 |
| 5,229,532 | A | 7/1993 | Brooks | 42/70.01 |
| 5,233,777 | A | 8/1993 | Waterman, Jr. et al. | 42/70.11 |
| 5,239,767 | A | 8/1993 | Briley, Jr. et al. | 42/70.11 |
| 5,241,770 | A | 9/1993 | Lambert | 42/70.11 |
| 5,289,653 | A | 3/1994 | Szebeni et al. | 42/70.11 |
| 5,315,778 | A | 5/1994 | Wolford | 42/70.11 |
| 5,398,438 | A | 3/1995 | Williams | 42/70.11 |
| 5,450,685 | A * | 9/1995 | Peterson | 42/70.11 |
| 5,457,907 | A | 10/1995 | Brooks | 42/70.11 |
| 5,488,794 | A | 2/1996 | Arrequin | 42/70.11 |
| 5,491,918 | A | 2/1996 | Elmstedt | 42/70.11 |
| 5,502,915 | A | 4/1996 | Mendelsohn et al. | 42/70.11 |
| 5,515,634 | A | 5/1996 | Kong | 42/70.11 |
| 5,519,956 | A | 5/1996 | Howell | 42/70.08 |
| 5,535,537 | A | 7/1996 | Avganim | 42/70.07 |
| 5,546,690 | A | 8/1996 | Ciluffo | 42/70.11 |
| 5,548,915 | A | 8/1996 | Szarmach et al. | 42/70.11 |
| 5,551,181 | A | 9/1996 | Upton | 42/70.11 |
| 5,560,135 | A | 10/1996 | Ciluffo | 42/70.07 |
| 5,561,935 | A | 10/1996 | McCarthy et al. | 42/70.11 |
| 5,564,211 | A | 10/1996 | Mossberg et al. | 42/70.11 |
| 5,570,528 | A | 11/1996 | Teetzel | 42/70.11 |
| 5,579,923 | A | 12/1996 | Hemmerlein | |
| 5,581,927 | A | 12/1996 | Meller | 42/70.11 |
| 5,603,179 | A | 2/1997 | Adams | 42/70.11 |
| 5,603,180 | A | 2/1997 | Houze | 42/70.11 |
| 5,611,164 | A | 3/1997 | Rassias | |
| 5,621,996 | A | 4/1997 | Mowl, Jr. | 42/70.07 |
| 5,636,464 | A | 6/1997 | Ciluffo | 42/70.11 |
| 5,638,627 | A | 6/1997 | Klein et al. | 42/70.07 |
| 5,664,358 | A | 9/1997 | Haber et al. | 42/70.11 |
| 5,669,252 | A | 9/1997 | Bentley | 42/70.04 |
| 5,671,560 | A | 9/1997 | Meller | 42/70.11 |
| 5,675,925 | A | 10/1997 | Würger | 42/70.11 |
| 5,680,723 | A | 10/1997 | Ruiz | 42/70.11 |
| 5,680,724 | A | 10/1997 | Peterken | 42/70.11 |
| 5,699,687 | A | 12/1997 | Pittman | 42/70.11 |
| 5,704,151 | A | 1/1998 | West et al. | 42/70.07 |
| 5,704,153 | A | 1/1998 | Kaminski et al. | 42/70.11 |
| 5,713,149 | A | 2/1998 | Cady et al. | 42/70.06 |
| 5,720,193 | A | 2/1998 | Dick | 42/70.11 |
| 5,724,760 | A | 3/1998 | Langner | 42/70.07 |
| 5,732,497 | A | 3/1998 | Brooks | 42/70.11 |
| 5,732,498 | A | 3/1998 | Arreguin | 42/70.11 |
| 5,737,864 | A | 4/1998 | Otto | 42/70.11 |
| 5,743,039 | A | 4/1998 | Garrett | 42/70.11 |
| 5,749,166 | A | 5/1998 | Brooks | 42/70.11 |
| 5,755,054 | A | 5/1998 | Tuller | 42/70.07 |
| 5,758,524 | A | 6/1998 | Yu | 42/70.11 |
| 5,768,816 | A | 6/1998 | Rassias | 42/70.11 |
| 5,768,819 | A | 6/1998 | Neal | 42/70.11 |
| 5,779,114 | A | 7/1998 | Owens | |
| 5,782,028 | A | 7/1998 | Simon et al. | 42/70.11 |
| 5,782,029 | A | 7/1998 | Brooks | 42/70.11 |
| 5,784,819 | A | 7/1998 | Roper | 42/70.11 |
| 5,829,179 | A | 11/1998 | Carter et al. | 42/70.07 |
| 5,832,647 | A | 11/1998 | Ling et al. | 42/70.07 |
| 5,860,241 | A | 1/1999 | Waters | 42/70.11 |
| 5,867,930 | A | 2/1999 | Kaminski et al. | 42/70.11 |
| 5,890,310 | A | 4/1999 | Bogstrom | 42/70.11 |
| 5,896,691 | A | 4/1999 | Kaminski et al. | 42/70.11 |
| 5,910,003 | A | 6/1999 | Kleinpaul | 42/70.11 |
| 5,913,666 | A | 6/1999 | Perkins | 42/70.11 |
| 5,915,936 | A | 6/1999 | Brentzel | 42/70.11 |
| 5,918,402 | A | 7/1999 | Weinraub | 42/70.07 |
| 5,918,403 | A | 7/1999 | Lurz, Jr. et al. | 42/70.11 |
| 5,918,492 | A | 7/1999 | Klebes | 42/70.11 |
| 5,924,232 | A | 7/1999 | Rhoden et al. | 42/70.11 |
| 5,926,989 | A | 7/1999 | Oliver, Sr. | 42/70.11 |
| 5,930,929 | A | 8/1999 | Bubits | 42/70.06 |
| 5,930,930 | A | 8/1999 | Howell | 42/70.11 |
| 5,934,000 | A | 8/1999 | Hayes, Sr. | |
| 5,946,840 | A | 9/1999 | Mickel | 42/70.11 |
| 5,946,841 | A | 9/1999 | Roper | 42/70.11 |
| 5,950,344 | A | 9/1999 | Ross | 42/70.11 |
| 5,953,844 | A | 9/1999 | Harling et al. | 42/70.06 |
| 5,960,575 | A | 10/1999 | Chiovitt et al. | 42/70.11 |
| 5,966,859 | A | 10/1999 | Samuels | 42/70.11 |
| 5,974,717 | A | 11/1999 | Brooks | 42/70.11 |
| 5,987,796 | A | 11/1999 | Brooks | 42/70.11 |
| 5,992,076 | A | 11/1999 | Magnusson | 42/70.11 |
| 6,009,654 | A | 1/2000 | Williams et al. | 42/70.11 |
| 6,032,396 | A | 3/2000 | Shapiro | 42/70.06 |
| 6,041,536 | A | 3/2000 | Samuels et al. | 42/70.11 |
| 6,052,934 | A | 4/2000 | Carpenter | 42/70.11 |
| 6,098,330 | A | 8/2000 | Schmitt et al. | 42/70.11 |
| 6,122,851 | A | 9/2000 | Perkins | 42/70.11 |
| 6,125,568 | A | 10/2000 | Granaroli | 42/70.11 |
| 6,128,847 | A | 10/2000 | Langner | 42/106 |
| 6,134,822 | A | 10/2000 | Murgel | 42/70.07 |
| 6,141,896 | A | 11/2000 | Oberst | 42/70.06 |
| 6,142,313 | A | 11/2000 | Young | |
| 6,154,996 | A | 12/2000 | Andreassen | 42/70.11 |
| 6,170,186 | B1 | 1/2001 | Reed | 42/70.11 |
| 6,173,518 | B1 | 1/2001 | Oberst | 42/70.06 |
| 6,185,852 | B1 | 2/2001 | Whalen et al. | 42/70.11 |
| 6,202,336 | B1 * | 3/2001 | Audino | 42/70.11 |
| 6,205,695 | B1 | 3/2001 | Schnell | 42/70.07 |
| 6,212,813 | B1 | 4/2001 | Luna et al. | 42/70.11 |
| 6,219,952 | B1 | 4/2001 | Mossberg et al. | 42/70.01 |
| 6,223,461 | B1 | 5/2001 | Mardirossian | 42/70.11 |
| 6,226,914 | B1 | 5/2001 | Reed | 42/70.11 |
| 6,237,272 | B1 | 5/2001 | Scott | 42/70.11 |
| 6,240,670 | B1 | 6/2001 | Findlay | 42/70.08 |
| 6,250,008 | B1 | 6/2001 | Silver | 42/70.01 |
| 6,405,472 | B1 | 6/2002 | Dojcsak | 42/70.11 |
| 6,418,654 | B1 | 7/2002 | Trois et al. | 42/70.11 |

* cited by examiner 80
66a
106a
84
66b
68
70
90
58
54
Z
82
66
92
110
100
62
59
50
50a
90b
64
90b
50

GUN BARREL SAFETY LOCK WITH HAND RATCHETING WRENCH

This application is a continuation-in-part of prior application Ser. No. 10/027,034; filed Dec. 20, 2001 now U.S. Pat No. 6,701,655, which is incorporated by reference herein.

BACKGROUND OF THE INVENTION

The present invention relates to the art of gun or firearm safety. It finds particular application in conjunction with barrel locks or plugs, and will be described with particular reference thereto. However, it is to be appreciated that the present invention is also amenable to other like applications.

Firearm safety is a concern for most gun owners. In general, gun owners desire a way to secure their firearms from unauthorized use and/or accidental discharge. Accordingly, devices have been developed to achieve this goal. However, many of the prior art devices suffer from various drawbacks and/or limitations.

For example, trigger locks have been developed which when properly installed on a gun prevent an unauthorized user from squeezing the gun's trigger. While these trigger locks may prevent a gun's firing mechanism from being intentionally activated, trigger locks generally do not prevent a gun from being loaded. Accordingly, a live round can still be positioned in the firing chamber and a sudden jarring of the gun and/or faulty ammunition can potentially result in the accidental discharge of the weapon.

Another safety device for securing firearms is the so called barrel plug which is designed to wedge in and/or otherwise obstruct the gun's barrel. The previously developed barrel plugs also have drawbacks and/or limitation. Many of the prior art barrel plugs cannot easily and quickly be installed and removed. Others are not sufficiently tamper resistant and/or secure. That is to say, the security of some prior art barrel plugs can be frustrated with relative ease by an unauthorized user, e.g., pulling or pushing or otherwise removing the plug from the barrel. Furthermore, prior art barrel plugs tend to be of limited use insomuch as each only fits one preset caliber or bore size.

While obstructing the barrel, often barrel plugs do not prevent loading of the firearm. This is particularly hazardous when the barrel plug is completely hidden within the barrel. For example, a unsuspecting user, not knowing the barrel plug is installed and not seeing any external evidence of its installation, may load and attempt to fire the gun. Of course, the gun will potentially backfire or otherwise injure the user and/or damage either the firearm or the barrel plug or both.

The present invention contemplates a new and improved gun barrel safety lock with hand ratcheting wrench which overcomes the above-referenced problems and others.

SUMMARY OF THE INVENTION

A gun safety device includes a barrel plug assembly having a first compression member, a second compression member, an expansion member, a joining member, and an adjustable extension rod assembly. The expansion member is sandwiched between the first compression member and the second compression member. The joining member is operatively linking the first compression member to the second compression member. The joining member is adapted to draw at least one of the compression members towards the other compression member. The adjustable extension rod assembly extends from the second compression member.

A gun safety device includes a barrel plug assembly having an adjustable rod assembly and a selectively expandable portion. The adjustable rod assembly adjusts the length of the barrel plug assembly. The selectively expandable portion selectively engages the barrel of an associated gun. The adjustable rod assembly includes a tubular extension and a slidable rod received in the tubular extension.

BRIEF DESCRIPTION OF THE DRAWINGS

The invention may take form in various components and arrangements of components, and/or in various steps and arrangements of steps. The drawings are only for purposes of illustrating preferred embodiments and are not to be construed as limiting the invention.

DETAILED DESCRIPTION OF THE PREFERRED EMBODIMENT(S)

With reference to the FIGURES, in particular FIGS. 1A–1D and 4, an exemplary gun barrel safety lock with hand ratcheting wrench in accordance with a preferred embodiment of the present invention includes a barrel plug assembly A (see also FIGS. 2A and 2B) and a selectively detachable hand ratcheting wrench assembly B (see also FIGS. 3A–D) which is used to selectively install and uninstall the barrel plug assembly A in the barrel of a firearm. The barrel plug assembly A is readily adaptable and may be installed in any firearm regardless of type (i.e., handgun, rifle, shotgun or otherwise), barrel length, the existence of a flash guard, caliber, gauge or bore diameter, number of barrels, or method of loading. With the plug assembly A installed, the barrel of the firearm is blocked and the firearm is therefore secured from unauthorized operation insomuch as the plug assembly cannot be removed without the corresponding hand ratcheting wrench assembly B. Additionally, an optional plug extension 24 which is part of the plug assembly A will prevent the firearm from having a round of ammunition loaded in the firing chamber, aligned with the barrel, or otherwise placed in a firing position. Moreover, in accordance with preferred embodiments, the barrel safety lock is very compact and rugged.

Figures 1A, 1B, 1C, 1D:
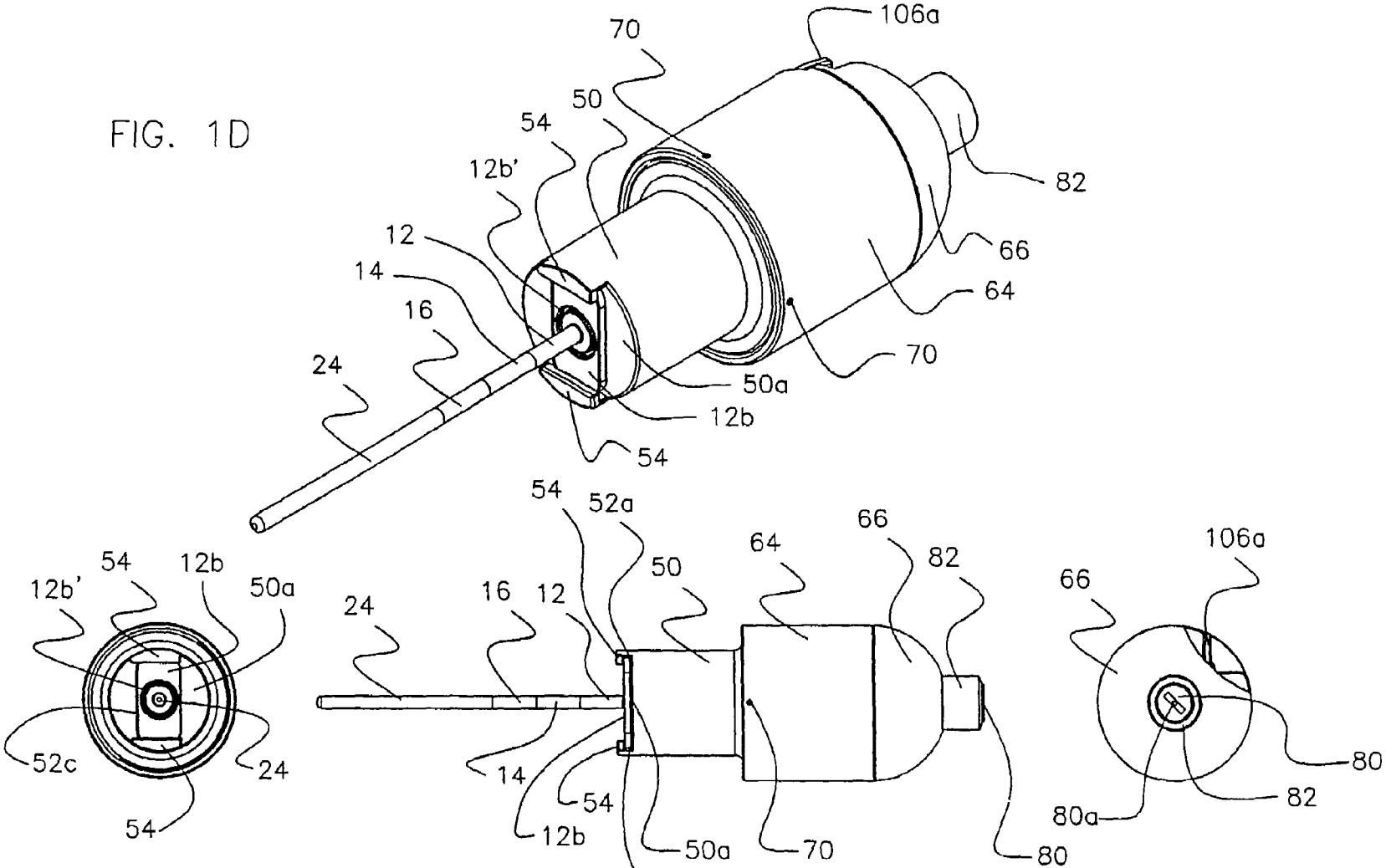
FIGS. 1A through 1D show side, top, bottom and perspective views, respectively, of an exemplary gun barrel safety lock with an attached hand ratcheting wrench in accordance with aspects of the present invention.
Figure 2A:
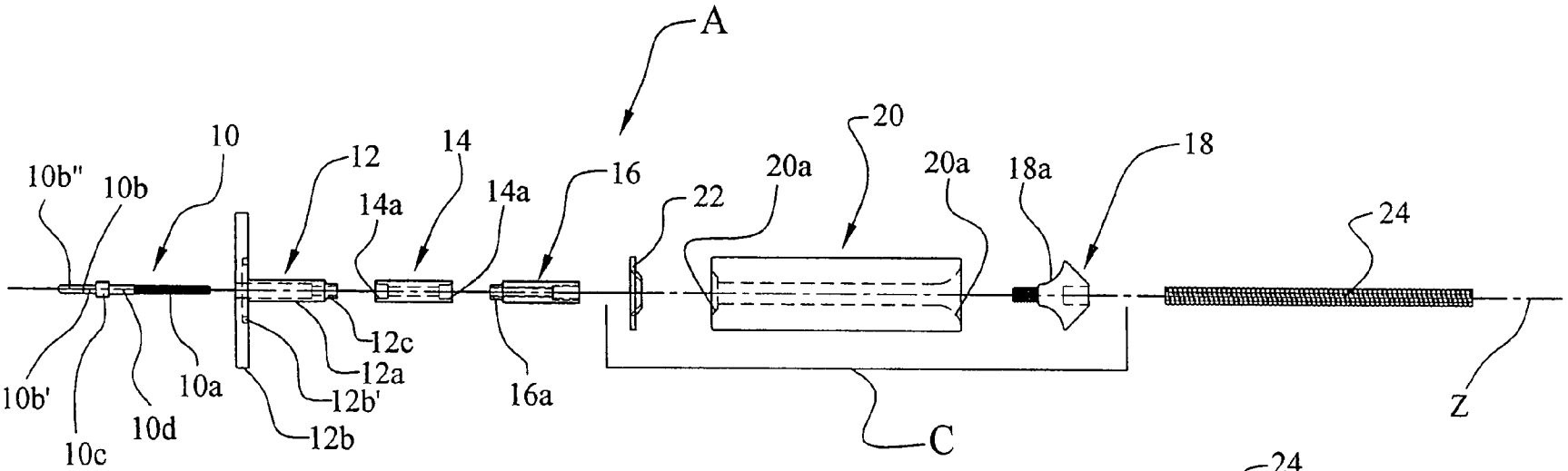
FIG. 2A shows an exploded side view (with internal features being represented by dashed line) of an exemplary barrel plug assembly in accordance with a preferred embodiment of the present invention and as also shown in FIGS. 1A–1D.
Figure 2B:
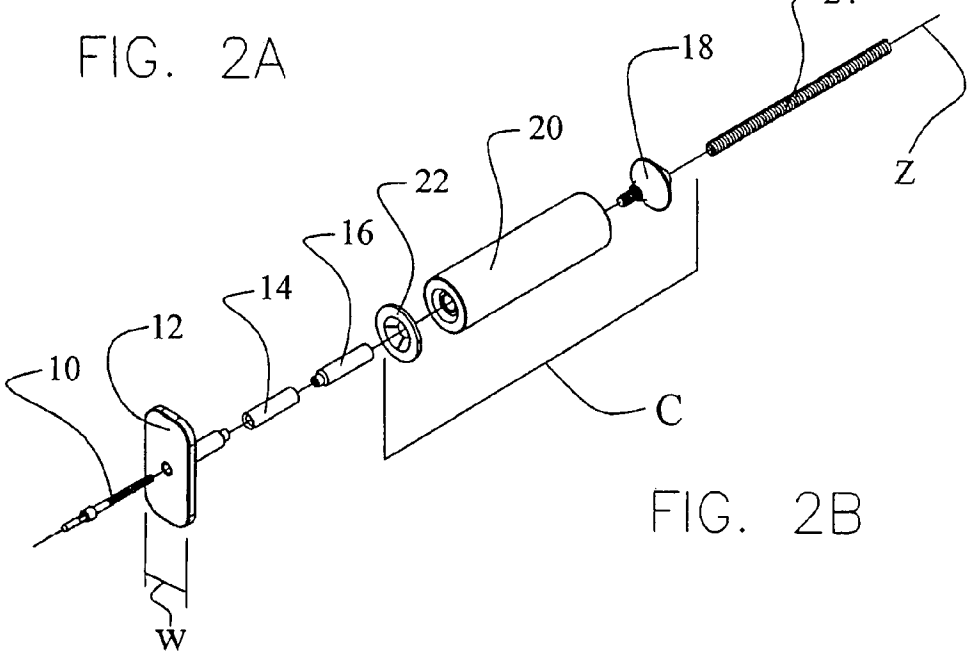
FIG. 2B shows an exploded perspective view of the barrel plug assembly of FIG. 2A.

The barrel plug assembly A is installed in the bullet exit end or muzzle of a gun barrel. As best seen in FIGS. 2A and 2B, the barrel plug assembly A is made up of eight components identified by reference numbers 10–24. A bolt 10 includes opposing threaded 10*a* and head 10*b* ends. The head 10*b* is preferably a male hexagon or other like key that is matched or mated to a socket 90*b* of an extraction rod 90 included in the wrench assembly B (see, e.g., FIGS. 3A–3D and 4). Optionally, the head 10*b* and the socket 90*b* are uniquely matched or mated so that no other combination of head 10*b* and socket 90*b* will properly fit together with one another. In this manner, only the socket 90*b* of the wrench assembly B which was intended for use with a given plug assembly A will fit that plug assembly's bolt head 10*b*, and hence, only that wrench assembly B will be able to operate (i.e., turn) the bolt 10. In this case, there exists a one-to-one correspondence between the bolt head 10*b* and the socket 90*b* of each plug/wrench assembly pair. Alternately, there may not be a one-to-one correspondence therebetween. Rather, there may be a limited number of bolt head configurations that match corresponding socket configurations. Optionally, the number of configurations is large enough so that it is statistically unlikely that a randomly selected socket 90*b* would fit together with a given bolt head 10*b*.

In a preferred embodiment, the bolt 10 includes a bushing 10*c* which has a diameter larger than the bolt shaft 10*d* on which the threads 10*a* are formed. Preferably, the bold 10 is formed from stainless steel or other similar metal or material. The bolt head 10*b* includes a hexagonal of other key shaped region 10*b*' which lies beneath a protrusion or smooth stub 10*b*". Consequently, for the socket 90*b* to mate with the key portion 10*b*' of the bolt head 10*b* it has a matching recess which accepts the smooth stub 10*b*" when the bolt head 10*b* is received in the socket 90*b*.

A flanged bolt-retaining plug 12 is bonded to an expansion tube 14 which is in turn bonded to a threaded rear compression base 16. With respect to a central longitudinal axis z, the flanged bolt-retaining plug 12 includes a longitudinally extending cylindrical member 12*a* and a radially extending flange 12*b* at a first end thereof. The flanged bolt-retaining plug 12 is sized to and does receive and retain the bolt 10. An inner diameter of the cylindrical member 12*a* is two tiered. That is, the inner diameter of the cylindrical member 12*a* is tiered or stepped down to create an annular surface which is substantially normal to the axis z. The larger inner diameter of the cylindrical member 12*a* is sized to and does receive the bushing 10*c* of the bolt 10. The smaller inner diameter of the cylindrical member 12*a* is less than the outer diameter of the bushing 10*c*. The smaller inner diameter is sized to and does receive the shaft 10*d* of the bolt 10. In this manner, when the bolt 10 is inserted through the flanged bolt-retaining plug 12, the normal annular surface (created by the two tiered inner diameter of the cylindrical member 12*a*) abuts the bushing 10*c* thereby restricting the bolt 10 from passing longitudinally beyond a designated point with respect to the flanged bolt-retaining plug 12.

Preferably, the flanged bolt-retaining plug 12 is made of brass or other like metal or other similarly hard, durable and/or rigid material. The flange 12*b* is preferably a plate which is substantially normal to the axis z. The perimeter and thickness of the plate are shaped and sized to be selectively engaged non-rotatably with a flange receiving portion 50*a* of a lower handle mount 50 included in the wrench assembly B (see, e.g., FIG. 4). Optionally, the flange 12*b* and the flange receiving portion 50*a* are uniquely matched or mated so that no other combination of flange 12*b* and flange receiving portion 50*a* will properly fit together with one another. In this manner, only the flange receiving portion 50*a* of the wrench assembly B which was intended for use with a given plug assembly A will fit that plug assembly's flange 12*b*, and hence, only that wrench assembly B will be able to properly align with the plug assembly A and hold the flanged bolt-retaining plug 12 (and other components rotationally fixed thereto) rotationally fixed with respect to the lower handle mount 50. In this case, there exists a one-to-one correspondence between the flange 12*b* and the flange receiving portion 50*a* of each plug/wrench assembly pair. Alternately, there may not be a one-to-one correspondence therebetween. Rather, there may be a limited number of flange configurations that match corresponding flange receiving configurations. Optionally, the number of configurations is large enough so that it is statistically unlikely that a randomly selected flange receiving portion 50*a* would fit together with a given flange 12*b*.

It is to be noted that the combinations of wrench assemblies B and plug assemblies A that will permit the selective installing and uninstalling of any given plug assembly A in a firearm barrel is able to be limited insomuch as for the combination to cooperate both the flange 12*b* and flange receiving portion 50*a* have to match and the bolt head 10*b* and the socket 90*b* have to match.

The expansion tube 14 is a cylindrical member preferably made of rubber or other like material which expands radially when compressed longitudinally and contracts radially when stretched longitudinally. A first end of the expansion tube 14 is bonded to the second end 12*c* of the cylindrical member 12*a* opposite the flange 12*b*. A first end of the compression base 16 is bonded to the second end of the expansion tube 14 opposite the flanged bold retaining plug 12. In this manner, the flanged bolt-retaining plug 12, the expansion tube 14 and the compression base 16 are all rotationally fixed with respect to one another. The bolt shaft 10*d* extends entirely through the inner diameter of the expansion tube 14 such that the threads 10*a* may be engaged with the compression base 16. The length of the bolt shaft 10*d* is preferably at least long enough to allow the expansion tube 14 to be longitudinally-uncompressed while the threads 10*a* are still engaged with the compression base 16 and the bushing 10*c* abuts the annular surface created by the two tiered inner diameter of the cylindrical member 12*a*.

The compression base 16 is also preferably made from brass or another suitable metal or like material. The first end of the compression base 16 (i.e., the end proximate the expansion tube 14) has a threaded inner diameter arranged to receive the threaded end 10*a* of the bolt 10. The second end is threaded or otherwise arranged to receive a screw-on expansion tube adapter 18 if the slide-on expansion tube 20 is being employed. Alternately, the plug extension 24 may be affixed to the second end of the compression base 16.

When the caliber, bore or otherwise the inner diameter of the barrel in which the plug assembly A is to be installed is essentially the same or some determined amount larger than the outer diameter of the longitudinally-uncompressed expansion tube 14 (which is substantially equal to the outer diameter of the compression base 16 and the cylindrical member 12*a*), then the bore adjusting components C (i.e., one-way locking push nut 22, slide-on expansion tube 20 and screw-on expansion tube adapter 18) are not used. Alternately, if the barrel bore is significantly larger, then the bore adjusting components C are used.

Essentially, there is a set of bore adjusting components C for each caliber or barrel bore diameter in which the plug assembly A may be installed. After determining the caliber or bore of the barrel in which the plug assembly A is to be installed, a user simply selects the set of bore adjusting components C designate for that barrel's inner diameter size or caliber. The outer diameters of the bore adjusting components C are substantially equal to or less than the inner diameter of the barrel in which they are intended to be used. The inner diameters of the one-way locking push nut 22 and slide-on expansion tube 20 allow them to fit snuggly over the outer diameters of the cylindrical member 12*a*, the longitudinally-uncompressed expansion tube 14 and the compression base 16.

Preferably, the expansion tube 14 and the sets of bore adjusting components C each fit a range of calibers or bore sizes. That is to say, as compared to O-rings and the like, the tubes 14 and 20 have a greater range of and/or capacity for radial expansion when longitudinally compressed. Accordingly, each individual tube size can fit and wedge into a number of different calibers or bore sizes.

Most preferably, between the tube 14 and one set of bore adjusting components C all calibers or bore sizes can be accommodated. In this case, the maximum radial expansion of the tube 14 is large enough to sufficiently wedge the plug assembly A in all barrels having inner diameters substantially equal to or less than the longitudinally-uncompressed outer diameter of the tube 20. The bore adjusting components C are therefore used when the inner diameter of the barrel is substantially equal to or greater than the outer diameter of the tube 20.

The one-way locking push nut 22 is preferably bonded to the first end of the slide-on expansion tube 20. When used, the combination is slid over the outside of the cylindrical member 12*a*, the longitudinally-uncompressed expansion tube 14 and the compression base 16. The combined length of the one-way locking push nut 22 and the slide-on expansion tube 20 is substantially equal to the combined length of the cylindrical member 12*a*, the longitudinally-uncompressed expansion tube 14 and the compression base 16. The bulbous screw-on expansion tube adapter 18 is sized so as not to fit through the inner diameter of the slide-on expansion tube 20, and the adapter 18 is preferably screwed onto the second end of the compression base 16 behind the second end of the slide-on expansion tube 20. Optionally, the adapter 18 may otherwise be attached to the compression base 16. When the bore adjusting components C are used then the plug extension 24 is affixed to the adapter 18.

Preferably, the adapter 18 is made out of brass or another metal or like material and the slide-on expansion tube 20 is made of the same or similar material as the expansion tube 14. The one-way locking push nut 22 is preferably made from spring steel or the like and the plug extension 24 is preferably a vinyl coated steel tension spring or the like. Alternately, the plug extension 24 may be a rigid member.

To affect installation, the distal end of the plug assembly A (with the expansion tube 14 and optional slide-on expansion tube 20 both being longitudinally uncompressed) is inserted into the bullet exit end of the barrel or muzzle of the firearm which is to be secured. As used herein the distal end of the plug assembly A refers to the end of the plug assembly A opposite the flange 12*b*. Preferably, the flange 12*b* is larger than the inner diameter of the barrel and hence limits the depth to which the plug assembly A is inserted. That is to say, the flange 12*b* remains outside the barrel, preferably, abutting the end of the barrel through which the plug assembly A was inserted.

Using the hand ratcheting wrench assembly B, the bolt 10 is rotated in a first direction (e.g., clockwise) relative to the flanged bolt-retaining plug 12 which is held rotationally fixed with the flange receiving portion 50*a* of a lower handle mount 50 included in the wrench assembly B. Insomuch as the expansion tube 14 and the compression base 16 are rotationally fixed with respect to the flanged bolt-retaining plug 12, they are also rotationally fixed relative to the rotating bolt 10. Accordingly, due to the threaded engagement between the compression base 16 and the bolt 10 and the bushing 10*c* abutting the substantially normal annular surface created by the two tiered inner diameter of the cylindrical member 12*a*, the relative rotation of the bolt 10 with respect to the compression base 16 causes the compression base 16 and the flanged bolt-retaining plug 12 to be drawn together thereby longitudinally compressing the expansion tube 14 therebetween. Likewise, if the bore adjustment components C are being used, the screw-on expansion tube adapter 18 is drawn with the compression base 16 toward the flanged bolt-retaining plug 12 thereby longitudinally compressing the slide-on expansion tube 20 therebetween.

The longitudinal compression of the expansion tube 14 causes the expansion tube 14 to bulge or radially expand and/or wedge against the inner diameter of the barrel in which it was inserted thereby securing the plug assembly A in the same. Alternately, if the slide-on expansion tube 20 is being employed, the expansion tube 14 bulges and/or applies a radially extending force outwardly against the inner diameter of the slide-on expansion tube 20. At the same time, the slide-on expansion tube 20 will bulge or radially expand and/or wedge against the inner diameter of the barrel in which it was inserted. The dual wedging of the expansion tubes 14 and 20 prevents the barrel plug assembly A from being removed. In either case, the hand ratcheting wrench assembly B may then be removed, and absent access to the corresponding wrench assembly B, the firearm is now secured from unauthorized use.

To uninstall the plug assembly A from a barrel, the hand ratcheting wrench assembly B is re-engaged with the plug assembly A and used to rotate the bolt 10 in a second direction opposite the first (e.g., counterclockwise) while the flanged bolt-retaining plug 12 is held rotationally fixed with the flange receiving portion 50*a* of a lower handle mount 50 included in the wrench assembly B. Again, insomuch as the expansion tube 14 and the compression base 16 are rotationally fixed with respect to the flanged bolt-retaining plug 12, they are also rotationally fixed relative to the rotating bolt 10. This time, however, the opposite relative rotation of the bolt 10 with respect to the compression base 16 releases the longitudinal compression applied to the expansion tube 14. Likewise, if the bore adjustment components C are being used, the longitudinal compression applied to the slide-on expansion tube 20 is also released. Upon the release of the longitudinal compression to the expansion tube 14 and/or the slide-on expansion tube 20, the bulge or radially expansion therein and/or the radial force exerted thereby subsides and the plug assembly A is no longer wedge against the inner diameter of the barrel in which it was inserted thereby freeing it for extraction from the same by pulling on the flange 12*b* with the hand ratcheting wrench assembly B. Then, if desired, the wrench assembly B may be detached from the plug assembly A. Alternately, the wrench assembly B may be detached prior to extracting the plug assembly A and the plug assembly A extracted by pulling on the flange 12*b* by hand. In either case, the firearm is now unsecured and ready for use.

It is to be appreciated that to prevent unwanted twisting and/or turning of various components while the bolt 10 is being rotated, the threaded rear compression base 16 and the flanged bolt-retaining plug 12 are bonded to the expansion tube 14. The screw-on expansion tube adapter 18 is also mechanically connected to the compression base 16 and therefore it is also rotationally fix with respect to the flanged bolt-retaining plug 12 which is held against rotation while the bolt 10 is being turned. Preferably, the slide-on expansion tube 20 is bonded to the screw-on expansion tube adapter 18 and the one-way locking push nut 22 is bonded to the slide-on expansion tube 20. All of the above mentioned bonded and affixed points cooperate not only to prevent each part from twisting and/or turning undesirably, they also give the barrel plug assembly's expansion tubes 14 and/or 20 the ability to be stretched and/or elongated when the bolt 10 is rotated to remove the barrel plug assembly A from the barrel. The aforementioned stretching and/or elongating is advantageous insomuch as it encourages the radial contraction of the expansion tubes 14 and/or 20 which might otherwise remain completely or partially expanded due to the shape memory characteristics of the material from which they are made. That is to say, if an elastic tube is longitudinally compressed for an extended period of time and then released, the elastic tube may not immediately relax and/or return to its original radial dimension on its own. Accordingly, there may be a tendency for the plug assembly A to remain somewhat wedged in the barrel and therefore its extraction from the barrel may be correspondingly hampered. However, in accordance with a preferred embodiment of the present invention, the relative bonding of the plug assembly components ensures that loosening of the bolt 10 will elongate and/or longitudinally stretch the expansion tubes 14 and/or 20 thereby encouraging their radial contraction which in turn facilitates quick and easy extraction of the plug assembly A from the barrel.

Of course, the longitudinal stretching is only achieved when the compression between the flanged bolt-retaining plug 12 and the base 16 is released via a loosening of the blot 10. That is to say, so long as the bolt 10 continues to hold the flanged bolt-retaining plug 12 and the base 16 drawn together, pulling on the flange 12*b* will not stretch or elongate the expansion tubes 14 and/or 20. In this manner, the degree to which the plug assembly A is wedged in the barrel is not lessened by merely pulling on the flange 12*b* without first untightening the bolt 10. Accordingly, security is not compromised by this feature.

It is to be appreciated that with the extension rod 90 locked in the extended position and the tabs 54 (described later herein) holding the flange 12*b* in the receiving portion 50*a* of the lower handle mount 50, the bolt 10 is kept from pushing out of the bolt-retaining plug 12 when it is loosened. The bushing 10*c* acts as a step such that the top of the bushing 10*c* will press against the bottom of the extraction rod's socket 90*b*. Consequently, loosening of the bolt 10 pushes the bolt-retaining plug 12 and the compression base 16 apart from one another and longitudinally elongates the tube 14 (and tube 20 if used) thereby radially contracting the same.

The flanged bolt-retaining plug 12 serves a number of purposes. It is used to prevent the barrel plug assembly A from being forced through the barrel, and it keeps the bolt 10 and the slide-on expansion tube 20 aligned within the assembly. The flanged bolt-retaining plug 12 also prevents the bolt 10 from being tampered with insomuch as the bolt 10 is recessed therein. The flange 12*b* also provides a means to hold desired plug assembly parts rotationally fixed while the bolt 10 is being turned. The flanged bolt-retaining plug 12 gives both the expansion tube 14 and the slide-on expansion tube 20 a compression point. The flange 12*b* is also used as an attachment point for the hand ratcheting wrench assembly B.

In addition to wedging the plug assembly A into the muzzle end of the firearm's barrel, the rest of the barrel will contain and/or be blocked by the plug extension 24 which may be optionally a rigid member or a tension spring (optionally, vinyl coated) or the like. Preferably, the plug extension 24 is long enough to extend into and/or through the loading chamber or the action/receiver portion of the firearm. Consequently, after the barrel plug assembly A has been locked into place, the plug extension 24 will not permit the firearm to be loaded.

Figure 7:
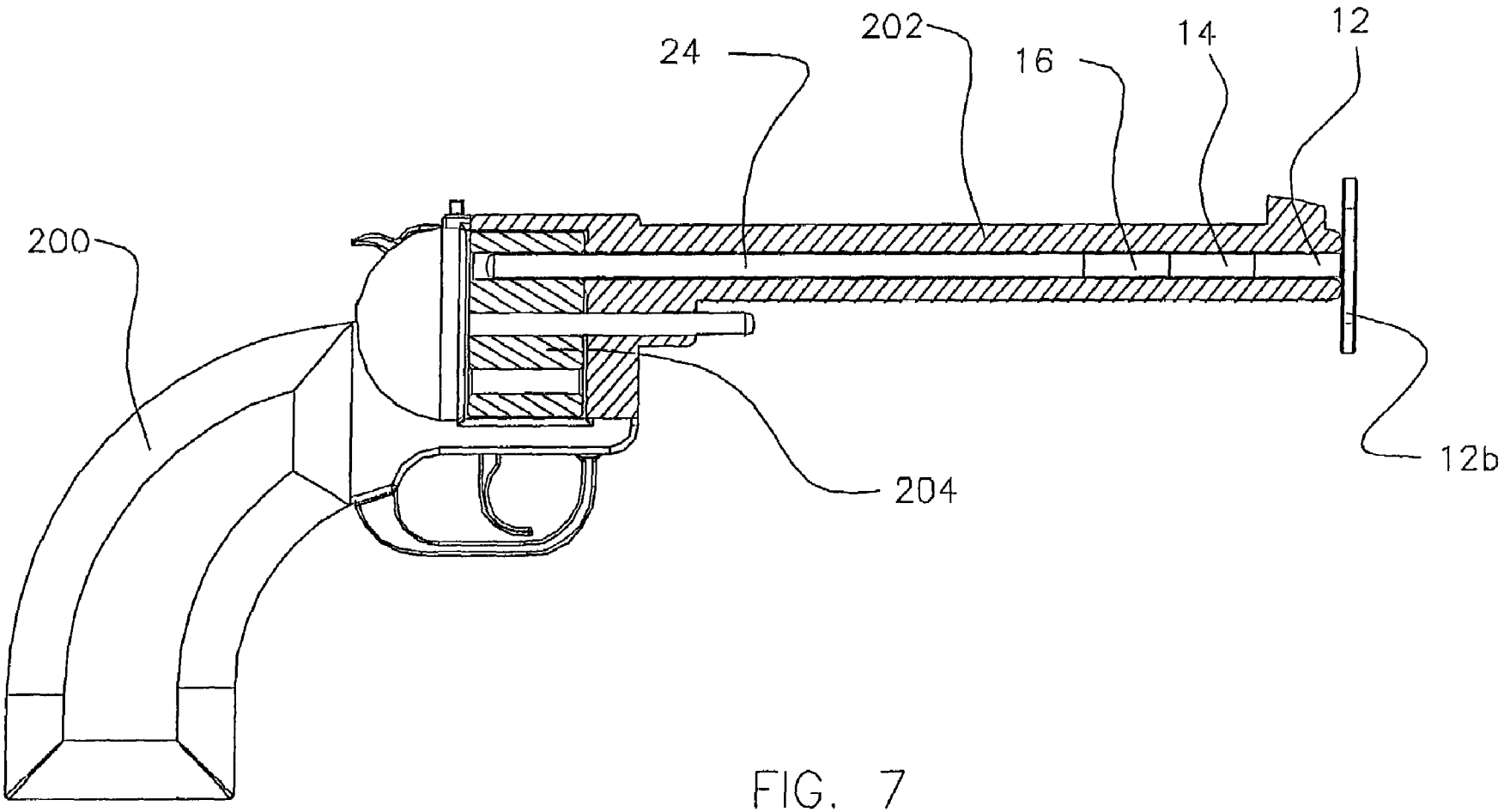
FIG. 7 shows a partially cut away side view corresponding to FIG. 5B.

Consider, for example, a revolver 200 having a barrel 202 and cylinder 204 (see, e.g., FIGS. 5A through 7). The plug assembly A may be locked into place when the revolver's cylinder 204 is removed from its firing position (not shown). With the plug extension 24 preferably extending into the cylinder housing, the cylinder 204 is prevented from being returned to the firing position and therefor a chamber in the cylinder 204 cannot be aligned with the barrel 202 or firing mechanism. Alternately, the plug assembly A may be installed when an empty cylinder chamber is in the firing position, e.g., as shown in FIG. 7. With the plug extension 24 preferably extending into a cylinder chamber, the cylinder 204 cannot therefore be removed for loading. Even if other chambers may be loaded without removing the plug assembly A, the cylinder 204 cannot be rotated to bring the loaded chamber into alignment with the barrel 202 and firing mechanism.

Preferably, the plug extension 24 is mechanically connected to the end of the compression base 16 (or the end of the screw-on expansion tube adapter 18, if used) so that it cannot be forcibly removed from the barrel.

As noted previously, the specially keyed bolt 10 prevents an individual from loosening the plug assembly A without the designated wrench assembly B. In a preferred embodiment, the bolt 10 has a head 10*b* which is designed with a smooth stud 10*b*" that protrudes from above the hexagonal or otherwise keyed potion 10*b*'. This combination of stud and keyed portion prevents an individual from loosening or unscrewing the bolt 10 and releasing plug assembly A from the barrel without the socket 90*b* that fits over the stud 10*b*" while mating up with keyed portion 10*b*'.

The bolt's bushing 10*c* also serves a number of purposes. For example, it facilitates easy engagement of the hand ratcheting wrench's extraction rod 90 (see, e.g., FIG. 4), it aids alignment and it is used as a pressure contact point. The bushing 10*c* is preferably arranged directly under the bolt head 10*b* and is an integral part of the bolt 10. It aids in keeping the bolt head 10*b* centered and aligned with the central axis z within the inner diameter of the flanged bolt-retaining plug 12. This centering/alignment ensures that the hand ratcheting wrench's extraction rod 90 can be readily and accurately engaged with and/or disengaged from the bolt head 10*b* which is located in the flanged bolt-retaining plug 12.

Preferably, there is a close tolerance fit between the outer diameter of the bushing 10*c* and the larger inner diameter of the cylindrical member 12*a* and between the bushing's interface with the normal annular surface created by the two tiered inner diameter of the cylindrical member 12*a*. This helps prevent the expansion tube 14 and the rear compression base 16 from bending out of alignment when the expansion tube 14 is compressed. The bushing 10*c* is also used as a contact point as it presses against the normal annular surface created by the two tiered inner diameter of the cylindrical member 12*a* when the bolt 10 is tightened to lock or wedge the barrel plug assembly A in the barrel.

The flanged bolt-retaining plug 12 has a number of noteworthy features. The flange 12*b* serves as a stop, is preferably slim line and compact, can fit any barrel size and is tamper resistant. The flange 12*b* is used as a "stop." The flange 12*b* will not permit the barrel plug assembly A to be forcibly pushed through the barrel's bore. It will also visually indicate if the barrel plug assembly A has been installed, and it ensures installation at the proper depth in the barrel's bore. Preferably, when properly installed, the bottom or under side of the flange 12*b* butt against the firearm's mussel or flash guard. As used here, the bottom or under side refers to the side of the flange 12*b* which is proximate the cylindrical member 12*a*.

The flange's shape mates with and is held by the hand ratcheting wrench's lower handle mount 50 (see, e.g., FIGS. 1A–1D and 4). The flange 12*b* can therefore be held against rotation. This prevents components rotationally fixed with respect to the flange 12*b* (e.g., the rear compression base 16) from rotating and/or turning when the hand ratcheting wrench assembly B applies a torque to the barrel plug assembly's bolt 10.

In a preferred embodiment, the flange 12*b* has a slim line and/or compact face, so that two or more of the barrel plug assemblies A, with the same or different calibers, can be mounted side by side in firearms with double barrels. See, e.g., the short dimension w shown in FIG. 2B.

If an excessive prying force or torque is applied to the flange 12*b*, the flange 12*b* is preferably designed to break away from the rest of the flanged bolt-retaining plug 12. This breakaway design is achieved in one preferred embodiment by machining a small groove 12*b*' (e.g., 0.500 inch in diameter, 0.063 inch wide and 0.062 inch deep) on the under side of the flange 12*b* and centered around the outer circumference of the cylindrical member 12*a*. Given an exemplary outer diameter of 0.200 inches for the cylindrical member 12*a*, and the 0.500 inch diameter of the portion of the flange 12*b* that remains after the rest has been forcibly broken off, there will remain a 0.150 inch flange shoulder (i.e., (0.500−0.200)/2=0.150). This 0.150 inch shoulder not only prevents the barrel plug assembly A from compromising any of its design and/or safety integrity, but also prevents an unauthorized individual from forcibly removing (by pushing and/or prying) the locked barrel plug assembly A from the barrel in which it is installed. That is to say, the shoulder is significant enough to prevent the plug assembly A from being pushed through the barrel, but not significant enough for someone to grab a hold of and/or use for leverage to pull the plug assembly A from the muzzle.

The flange 12*b* is also used as a stop and compression point for the slide-on expansion tube 20 and one-way locking push nut 22. That is to say, the flange 12*b* prevents them from moving forward, away from or out of the muzzle of the firearm, when the bolt 10 is tightened.

The taper end 12*c* of the flanged bolt-retaining plug 12 facilitates the installation and removal of the barrel plug assembly A. The tapered end 12*c* is mated to and "permanently" bonded with (e.g., via chemical bonding, adhesive or the like) one of the tapered ends 14*a* of the expansion tube 14. The tapered end of both parts, when combined, produce a greater bonding surface area and a stronger bond therebetween. This increases the ability of the expansion tube 14 to longitudinally compress or stretch and also prevents it from twisting/turning when a torque is applied to bolt 10 and the flanged bolt-retaining plug 12 is held rotationally fix. The greater bonding area, produced by the tapered ends, is particularly advantageous when the expansion tube 14 is stretched or elongated because, it will facilitate the removal of the barrel plug assembly A from the barrel. As previously pointed out, the stretching/elongating of the expansion tube 14, and hence radially contracting the same, is useful because if an elastic tube is compressed for an extended period of time and then released, the elastic tube may not immediately relax and return to its original condition/dimension. If the tube does not return to its original condition/ dimension on its own, it may cause the uncompressed elastic tube, or in this case, the expansion tube 14 to interfere/press against the inner diameter of the firearm barrel. Without longitudinally stretching/elongating the expansion tube 14, and hence radially contracting the same, it may be difficult to remove the barrel plug assembly.

Alternately, instead of using the tapered end and, e.g., chemically bonding between the flanged bolt-retaining plug 12 and the expansion tube 14, a longitudinally notched, annularly ribbed or like patterns or configurations are used in conjunction with a press fitting. The joint or connection thus formed is maintained via mechanical interference and/or the press fitting. This prevents the relative rotation of the joined parts. To keep the ends from separating, when the expansion tube 14 is stretched or elongate, a one-way locking push nut (e.g., similar to the one-way locking push nut 22) is optionally molded into the end of the expansion tube 14. The push nut is, e.g., made of spring steel with inward bent tabs. The tabs are bent in the same direction approximately 45 degrees out from the center of the push nut. In addition, the tabs are preferably equally spaced around the spring steel push nut's inner diameter. As the tabs engage/bends around the shaft/outer diameter of the flanged bolt-retaining plug 12, the spring steel push nut will grab onto the flanged bolt retaining plug and will not allow the expansion tube 14 to pull off of the flanged bolt-retaining plug 12.

It is to be noted that, optionally, in any of the same manners that the expansion tube 14 is affixed to the flanged bolt-retaining plug 12 it may also be affixed to the rear compression base 16.

In a preferred embodiment, the fit and clearance between the flanged bolt-retaining plug 12 and the specially keyed bolt 10 provides self alignment and tamper resistance. The flanged bolt-retaining plug 12 is designed so that the bolt 10 slides into its bore which is, e.g., 0.140 inches in diameter on the top or exposed side of the flange 12*b*. As used here the top or exposed side refers to the side or face of the flange 12*b* opposite of the cylindrical member 12*a*. To keep the bolt 10 from sliding all the way through the bolt-retaining plug 12, a fixed bushing 10*c* attached to or integrated with the bolt 10 abuts against the ledge or substantially normal annular surface created by the two tiered inner diameter of the cylindrical member 12*a*. The tolerances between the flanged bolt-retaining plug's bore diameter and the depth of the ledge, and the diameter of the bushing 10*c* and the distance from the bottom of the bushing 10*c* to the top of the stud 10*b*" is all arranged and/or maintained so that the barrel plug assembly A and the removable hand ratcheting wrench assembly B will work properly and provide a secure and tamper resistant device.

Preferably, the bolt 10 and the flanged bolt-retaining plug's hole or inner bore are slip fit toleranced so that the bolt 10 is essentially only able to move up or down along and/or in a rotational direction in relationship to the flanged bolt-retaining plug's center line or the axis z. In the flanged bolt-retaining plug 12, the combination of an axially normal ledge or annular surface and a longitudinal constraint (i.e., the wall of the bore), the barrel plug assembly A is substantially self aligning. Additionally, the axially normal ledge or annular surface is used as a contact point and as a longitudinal constraint for the bushing 10*c*. In one preferred embodiment, the axially normal ledge or annular surface is arranged at such a depth that the bolt rests approximately 0.25 inches below the top surface of the flange 12*b*. Accordingly, an individual without the hand ratcheting wrench assembly B will not be able to grab or hold onto the bolt head 10*b* due to the combined 0.25 inch depth and 0.140 inch diameter hole clearance.

The expansion tube 14 is preferably made from a petroleum resistant polymer synthetic elastomer material that has good compressive and tension characteristics. The tapered ends 14*a* of the expansion tube 14 are preferably chemically bonded, permanently, to the tapered end 12*c* of the flanged bolt-retaining plug 12 and the tapered end 16*a* of the rear compression base 16. The small diameter of the parts make the tapered end advantageous. The tapered ends permit a greater bonding area which in turn translates into a stronger bond and hence the advantages attendant thereto. The length of the expansion tube 14 also provides a larger gripping area. That is to say, the expansion tube's length provides a larger contact/gripping area and when longitudinally compressed creates a greater outside diameter, as compared to, e.g., conventional "O" rings. This feature enables the barrel plug assembly A to work with a range of different firearm calibers and/or bore diameters. However, for firearms with calibers or bore diameters too large for the expansion tube 14 to wedge up against itself, the slide-on expansion tube 20 may be used.

The distal end threaded rear compression base 16 is arranged to mate either with the screw-on expansion tube adapter 18 or the plug extension 24. Such versatility allows an individual to use barrel plug assembly A with different calibers or barrel bore diameter. The screw-on expansion tube adapter 18 is designed to quickly screw on to the back of the threaded rear compression base 16. This screw-on feature allows the barrel plug assembly A to be quickly and easily converted to a larger caliber/diameter (by selecting bore adjustment components C with varying outer diameters) without having to change the entire base assembly (i.e., elements 10–16 and 24). The plug extension 24 (optionally, rigid or tension spring) can also be screwed into the threaded rear compression base 16 or otherwise attached thereto by suitable means. Again, this screw-on feature allows the barrel plug assembly A to be quickly and easily converted to accommodate varying barrel lengths (by selecting plug extension 24 with varying lengths) without having to change out the entire base assembly.

The screw-on expansion tube adapter 18 is preferably designed to quickly screw-on to the back of the threaded rear compression base 16 when selected for use and the plug extension 24 can then be screwed into the tapered side of the expansion tube adapter 18.

In one preferred embodiment, the tapered end 18*a* of the expansion tube adapter 18 is bonded to the tapered end 20*a* of the slide-on expansion tube 20. Both parts are affixed together so that the slide-on expansion tube 20 can be effectively compressed or stretched/elongated, and be prevented from twisting. Again, to produce a stronger bonded area between both of the parts, the mated ends of the expansion tube adapter 18 and the slide-on expansion tube 20 are arranged with a tapered fit. The expansion tube adapter 18 preferably also has an approximately 45 degree chamfered distal end that is used to help guide the barrel plug assembly A into the muzzle during the installation process.

The plug extension 24 prevents the firearm from being loaded, which in turn, makes the weapon inoperable. In accordance with preferred embodiments, the plug extension 24 is optionally a rigid member or a tension spring. It is arranged to be readily attached to or screwed on to the tapered end of the screw-on expansion tube adapter 18 if employed, or alternately, to the threaded rear compression base 16.

The rigid plug extension 24 is arranged so that the extension 24 will not be able to be removed from the barrel plug assembly through the rear or breech of a firearm. That is to say, the length and inflexibility of the rigid plug extension 24 prevents it from being bent and/or pulled out laterally and/or rearwardly through the breach of the firearm. In a preferred embodiment, this rigid plug extension 24 will be available in a single length which will be cut to fit each respective barrel length. The rigid plug extension 24 enables the barrel plug assembly A to be lengthened so that it will be able to block the entire barrel of a firearm. The rigid plug extension 24 may be made of any lightweight material including aluminum, brass, fiberglass, semi-hard or hard rubber or the like. The lightweight material preferably has certain material characteristics such that, e.g., the material will not compress, is light-weight, has a minimal deflection and is soft enough not to scratch the barrel's inner bore.

The tension spring version of the plug extension 24 is preferably also arranged to be irremovable from the barrel plug assembly through the rear or breech of a firearm, and will preferably come in a single size that is cut to length for a particular firearm. The tension spring is preferably made of a heavy gauge galvanized steel wire and is shaped into a tight continuous-length closed-pattern spring that is vinyl covered and semi-flexible. The vinyl cover will protect the barrel from being scratched when the barrel plug assembly A is installed or removed from the barrel. When using the plug extension tension spring 24 with the barrel plug assembly A in a gun with a very long barrel, the flexibility of the tight continuous-length closed-pattern extension spring design will aid in the installation and removal of the barrel plug assembly A. The spring can also be curled up for easy storage. Accordingly, the user will not have to struggle with a small diameter long solid rod that could get bent or broken during installation, removal or storage.

The tapered end 20*a* of the slide-on expansion tube 20 that mates with the face of the one-way locking push nut 22 is preferably chemically or otherwise bonded thereto. The bonded ends preferably have an approximately 45 degree chamfer radius that produces a greater chemical bonding area therebetween. This creates a stronger bond and hence the advantages attendant thereto are achieved, e.g., the bonding strength for effectively compressing or stretching/elongating the tube 20, and to prevent it from twisting/turning when a torque is applied to the bolt 10.

A selection of slide-on expansion tubes 20 with varying outer diameters allows versatile use of the barrel plug assembly A. Particular slide-on expansion tubes 20 can be installed over the original barrel plug assembly (i.e., elements 12–16) to quickly, easily and inexpensively convert the original barrel plug assembly's smaller outer diameter to a larger outer diameter. This convenient conversion gives the gun owner the ability to use the same barrel plug assembly A in any firearm regardless of bore or the barrel's inner diameter.

The size and tolerance of the slide-on expansion tube's inner diameter is noteworthy with respect to the design and versatility of the barrel plug assembly A. Preferably, the slide-on expansion tube's inner diameter is designed to have a close slip fit tolerance, when installed over the original barrel plug assembly's cylindrical body. This close slip fit tolerance is arranged so that when the bolt 10 is tightened, not only will it cause the expansion tube 14 to longitudinally compress and bulge out, but it will also cause the slide-on expansion tube 20 to simultaneously longitudinally compress and bulge out. Since the expansion tubes 14 and 20 have such a close slip fit tolerance, the bulging out of the expansion tube 14 will immediately start to push radially outward on the slide-on expansion tube's inner diameter. This radial outward force helps lock the expansion tube 14 to the slide-on expansion tube 20 in the form of an interference fit. This interference fit resists the expansion tubes 14 and 20 from being forcibly separated when the barrel plug assembly A is installed. Also, the slide-on expansion tube 20 is made to have a more uniform distribution of radial and compressive forces exerted on the inner diameter on the firearm's bore. These uniformly distributed forces provide a tighter wedging force between the barrel and the slide-on expansion tube 20.

The slide-on expansion tube's long length also provides a larger contact/gripping area which is advantageous for larger caliber firearms and when compressed creates a greater outside diameter as compared to conventional "O" rings. The slide-on expansion tube's long length and greater contact/gripping area, will preferably not increase the overall length of the barrel plug assembly A due to the fact that the slide-on expansion tube 20 slides over substantially the entire combined length of the metal threaded rear compression base 16, the rubber expansion tube 14 and the cylindrical member 12*a* of the metal flanged bolt-retaining plug 12. The stop that the flanged bolt-retaining plug 12 provides, and the larger contact/gripping area that the slide-on expansion tube 20 provides, enable the barrel plug assembly A to work with all ranges of gun calibers without compromising security and durability.

The one-way locking push nut 22 is preferably chemically or otherwise bonded to the end 20*a* of the slide-on expansion tube 20. The bonded ends preferably have a slotted 45 degree chamfer radius that produce a greater bonding area between each part. This greater bonding area gives the one-way locking push nut 22 rigidity and strength, while giving the slide-on expansion tube 20 the needed bonding strength to effectively compress or stretch/elongate and also to prevent it from twisting/turning when a torque is applied to the specially keyed bolt 10.

In a preferred embodiment, the one-way locking push nut 22 is made of spring steel and is arranged with an approximately 45 degree chamfer radius that is slotted in four equally spaced places. In one preferred embodiment, the slotted 45 degree chamfer radius forms an approximate 0.190 inch diameter hole at its center. The 0.190 inch diameter center hole is sized to form an interference fit over the flanged bolt-retaining plug's 0.200 inch diameter metal cylindrical member 12*a*. The locking push nut 22 is a one way nut. The nut's slotted 45 degree chamfer radius is designed to flex around and over the flanged bolt-retaining plug's 0.200 inch diameter cylindrical member 12*a* when the nut is pushed forwards onto the same. After the one-way locking push nut 22, which is bonded to the slide-on expansion tube 20, has been installed over the cylindrical member 12*a*, the nut's slotted 45 degree chamfer radius hole's inner edge will dig/grab into the outer diameter of cylindrical member 12*a* when the slide-on expansion tube 20 is urged in the direction opposite the one-way nature of the nut 22, e.g., by pulling on the flange 12*b*. The harder an individual tries to separate the slide-on expansion tube 20 from the flanged bolt-retaining plug 12, the more the one-way locking push nut's 45 degree chamfer radius will dig and/or grab into the cylindrical member 12*a*.

The outside diameter of the one-way locking push nut 22 is preferably sized to cover the entire outer diameter of the slide-on expansion tube 20. If an unauthorized individual attempts to obtain access to the firearm by breaking away the flange 12*b* and damaging the petroleum resistant polymer synthetic elastomer material that the slide-on expansion tube 20 is made out of, the one-way locking push nut's, which is pressing against the portion of the flange remaining after the break-away (see, e.g., the above description), will create a steel barrier at the muzzle of the firearm. This barrier will prevent an unauthorized individual from damaging the barrel plug assembly A to the point where it could be forcibly removed from the barrel.

One preferred embodiment of the hand ratcheting wrench assembly B is shown in FIGS. 3A–D. The illustrated hand ratcheting wrench assembly B has multiple features. It is used to effect the installation the barrel plug assembly A in the bullet exit end/muzzle of a gun barrel, and it also is used to effect quick and easy removal of the barrel plug assembly A from the weapon's barrel (i.e., de-installation of the plug assembly A). In addition, the wrench assembly B serves as a torque limiter, a ratchet, an extraction rod retraction lock, an extraction rod extension lock, and as a holder/attachment point for the barrel plug assembly A.

The lower handle mount 50 is used to hold the barrel plug assembly A for easy installation and removal. As indicated above, the wrench assembly B is selectively engaged with the plug assembly A via the lower handle mount 50 which has a flange receiving portion 50*a* that mates with the flange 12*b* of the plug assembly A. The flange receiving portion 50*a* mates with the flange 12*b* such that the relative rotational orientation therebetween remains fixed so long as the wrench assembly B and the plug assembly A are engaged. In a preferred embodiment, during the installation and removal process, three mating sides 52*a–c* (best seen in FIGS. 1A and 1C) of the two combined parts will prevent the rest of the barrel plug assembly A from rotating when a torque is applied to the bolt 10.

Preferably, the flange 12*b* and the flange receiving portion 50*a* of the lower handle mount 50 have a close tolerance fit such that when the flange 12*b* is properly seated in the receiving portion 50*a* of the lower handle mount 50, an opening 56 is aligned along the longitudinal axis z with the bore of the flanged bolt-retaining plug 12 and the head 10*b* of the bolt 10 housed therein. In this manner, the flange receiving portion 50*a* of the lower handle mount 50 aligns and/or centers the wrench assembly B with the flanged bolt-retaining plug 12 so that the wrench's extraction rod 90 can easily and quickly be extended and/or retracted through the opening 56 for accurate selective engagement with the head 10*b* of the bolt 10 which is recessed in the flanged bolt-retaining plug 12.

The extraction rod 90 is aligned and/or guided though a hollow shaft 58 (best seen in FIGS. 3B and 3C) in the lower handle mount 50 which terminates in the opening 56. Preferably, the shaft 58 and opening 56 are slip fit toleranced so that the extraction rod 90 can slide longitudinally therethrough and rotate therein with only a minor end play or deviation from the center line or axis z. A close tolerance assures that the extraction rod 90 will be properly aligned with the head 10*b* of the bolt 10 located in the flanged bolt-retaining plug 12.

Elbow shaped tabs 54 form a slot into which the flange 12*b* is laterally slid or otherwise radially received with respect to the axis z. When the wrench and plug assemblies are engaged with one another (see, e.g., FIG. 1A), the tabs 54 wrap around the flange 12*b* restricting it from longitudinal separation from the lower handle mount 50 and hence the wrench assembly B. Moreover, when flange 12*b* is properly engaged with and/or seated in the receiving portion 50*a* of the lower handle mount 50 and the extraction rod 90 is in the extended position (as shown in FIG. 3C), the extraction rod 90 extends through the opening 56 and into the bore of the flanged bold-retaining plug 12 such that the plug 12 (and hence the plug assembly A) is restricted from sliding out of the slot laterally or radially with respect to the axis z. Accordingly, when the extraction rod 90 is extended, the plug and wrench assemblies are effectively locked together insomuch as the tabs 54 restrict the flange 12*b* from being longitudinally disengaged from the lower handle mount 50 and the extraction rod 90 extending into the bore of the flanged bolt-retaining plug 12 restricts the plug 12 from being laterally disengaged from the lower handle mount 50. This locking feature permits the barrel plug assembly A and the hand ratcheting wrench assembly B to work as one assembly, and therefore makes the installation and removal of the barrel plug assembly A a simple, one handed procedure. In addition, if the two assemblies are left together, in the locked position, when the barrel plug assembly A is not installed in a gun, the two assemblies will not become separated and one will not become lost or separated from the other when stored away.

An upper portion 60 of the wrench assembly B is defined by three parts, namely, a inner retaining disk 62, a housing drum 64 and a housing cap 66, which collectively house or contain the wrench assembly components or parts numbered with reference numerals 80 through 110. The housing drum 64 is sandwiched between the inner retain disk 62 and the housing cap 66 which are secured to one another via a plurality of screws 68 or other like fasteners. Preferably, the lower handle mount 50, the inner retaining disk 62, the housing drum 64 and the housing cap 66 are formed or made from a suitably strong, hard, rigid and/or durable material, such as, aluminum or other metal or like material.

The upper portion 60 and the lower handle mount 50 are joined so as to be freely rotatable about the central z axis with respect to one another. Preferably, as shown, a plurality of set screws 70 extend through the housing drum 64 into a circumferential channel 59 formed in the end of the lower handle mount which is arranged inside the end of the housing drum 64 opposite the housing cap 66. In this manner, the upper portion 60 and lower handle mount 50 are joined together while being free to rotate about the z axis relative to one another.

The lower hand mount 50 is used to selectively secure the extraction rod 90 from unauthorized use and/or tampering. That is to say, to make the ratcheting wrench assembly B tamper resistant and/or to provide additional security, a user may choose to retract the extraction rod 90 upward into the lower hand mount 50. Retracting the extraction rod 90 into the lower hand mount 50 will protect the extraction rod 90 from being damaged if the hand ratcheting wrench assembly B is dropped, and will also prevent an unauthorized individual from using the hand ratcheting wrench assembly B. FIG. 3B shows the extraction rod in the retracted position, and FIG. 3C shows the extraction rod 90 in the extended position.

The extraction rod 90 is selectively moved and locked into each of the respective positions shown in FIGS. 3B and 3C by using a keyed push lock assembly which includes a lock cylinder 80, a lock cylinder housing 82, a locking lever 84, a washer 86 and a screw 88. As shown, the washer 86 is an external toothed lock washer, and the screw 88 is a cross recessed pan head machine screw, however, alternate fasteners may be used. The screw and washer 88 and 86, respectively, fasten the locking lever 84 to the lock cylinder 80 which is housed in the lock cylinder housing 82.

The lock cylinder 80 is operated with a key (not shown) that fits in a key hole 80*a* (best seen in FIG. 1B) so as to selectively rotate within the lock cylinder housing 82. By rotating the lock cylinder 80, the locking lever 84 fastened thereto is selectively engaged with (or disengaged from) one of two receiving slots 66*a* and 66*b* formed in the housing cap 66. When cylinder 80 is rotated such that the lever 84 is disengaged from both slots 66*a* and 66*b*, the cylinder 80 and cylinder housing 82 are free to move longitudinally along the z axis. When cylinder 80 is rotated and longitudinally positioned such that the lever 84 is engaged with slot 66*a*, the cylinder 80 and cylinder housing 82 are locked in the undepressed position shown in FIG. 3B. When cylinder 80 is rotated and longitudinally positioned such that the lever 84 is engaged with slot 66*b*, the cylinder 80 and cylinder housing 82 are locked in the depressed position shown in FIG. 3C.

In a preferred embodiment, the extraction rod 90 has a head 90*a* opposite the socket 90*b*. The head 90*a* of the extraction rod 90 is urged or pressed against a butt end 82*a* of the lock cylinder housing 82 by a compression spring 92 acting on a spring retainer 94 which is positioned between one end of the spring 92 and the head 90*a* of the extraction rod 90. The end of the compression spring 92 opposite the spring retainer 94 pushes off a fixed interior lateral ledge or annular lip within the housing drum 64. Accordingly, the spring 92 pushes or urges the extraction rod 90 toward the lock cylinder housing 82, and biases the push lock to the undepressed position and the extraction rod 90 to the retracted position, as shown in FIG. 3B. As the extraction rod 90 is biased against the butt end 82*a* of the lock cylinder housing 82, the position of the extraction rod 90 is controlled by the longitudinal position of the of the push lock. When the push lock is moved into and/or locked in the depressed position, it effects the placement of the extraction rod 90 into the extended position, as shown in FIG. 3C, and when the push lock is moved into and/or locked in the undepressed position, it effects the placement of the extraction rod 90 into the retracted position, as shown in FIG. 3B.

Figure 3A:
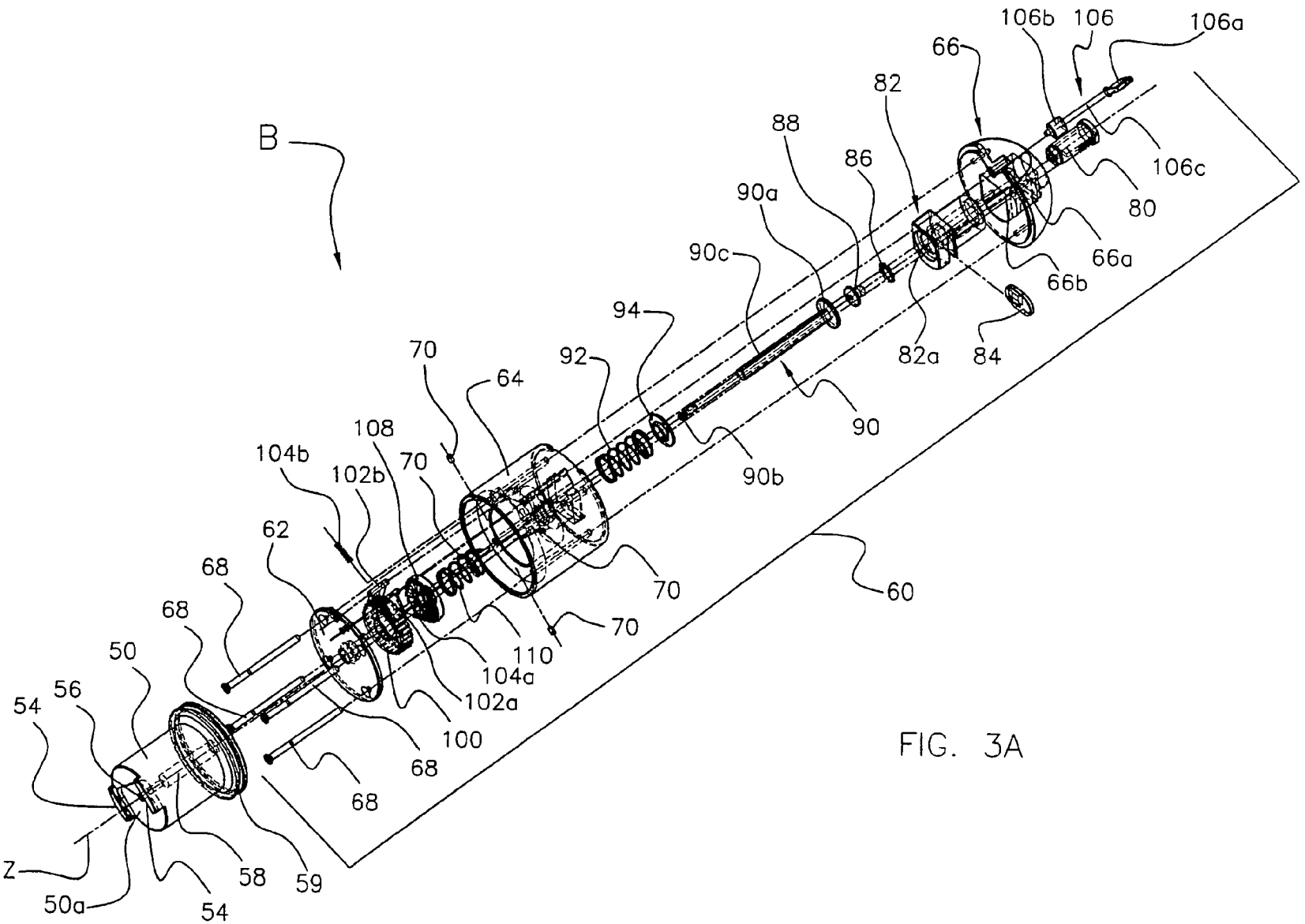
FIG. 3A shows an exploded perspective view (with internal features being represented by dashed line) of an exemplary hand ratcheting wrench assembly in accordance with a preferred embodiment of the present invention and as also shown in FIGS. 1A–1D.
Figures 3B, 3C, 3D:
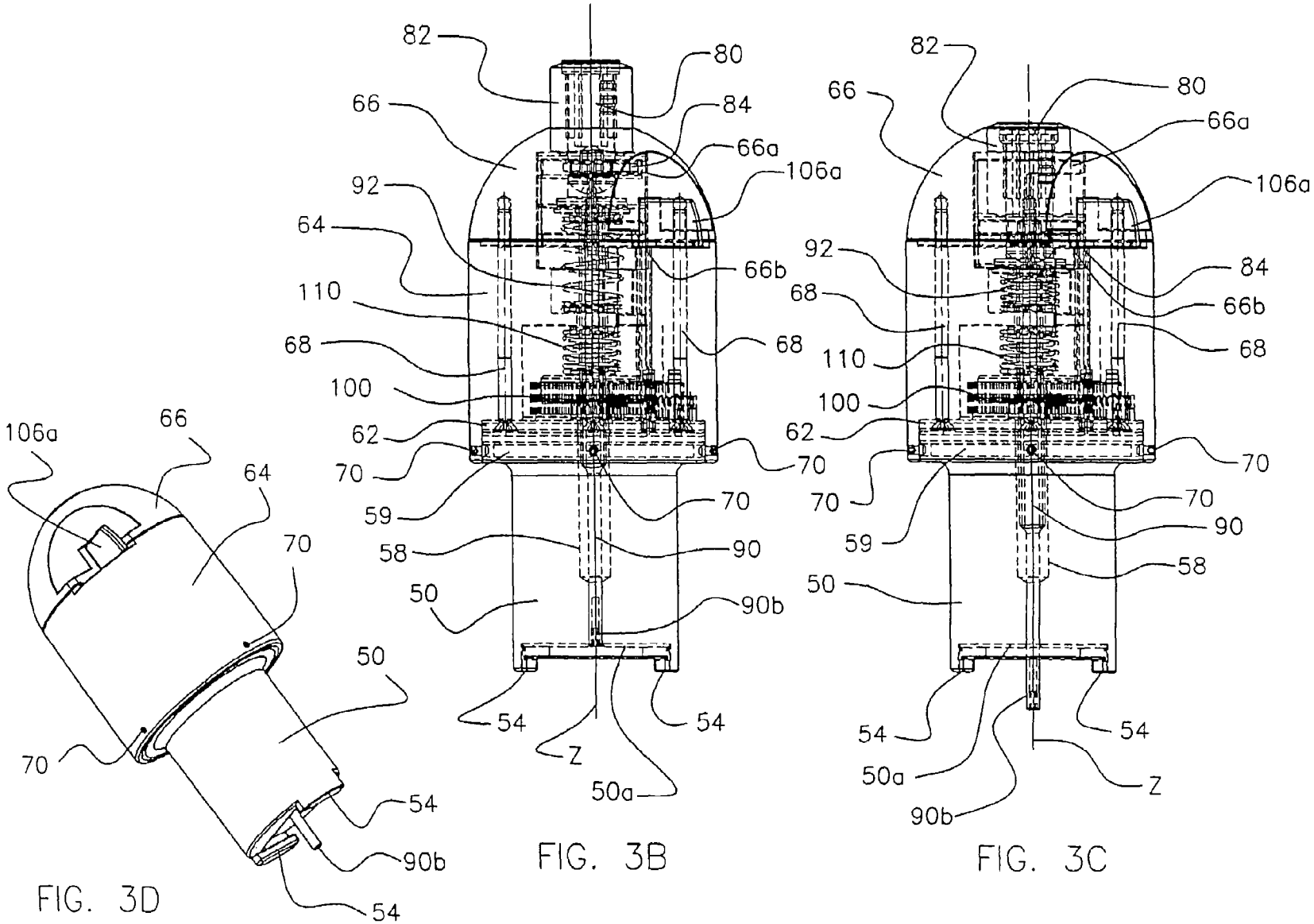
FIGS. 3B and 3C show side views (with internal features being represented by dashed line) of the hand ratcheting wrench assembly of FIG. 3A, with an extraction rod locked in the retracted and extended positions, respectively.
FIG. 3D shows a perspective view of the hand ratcheting wrench assembly of FIG. 3A with the extraction rod locked in the extended position.
Figure 4:
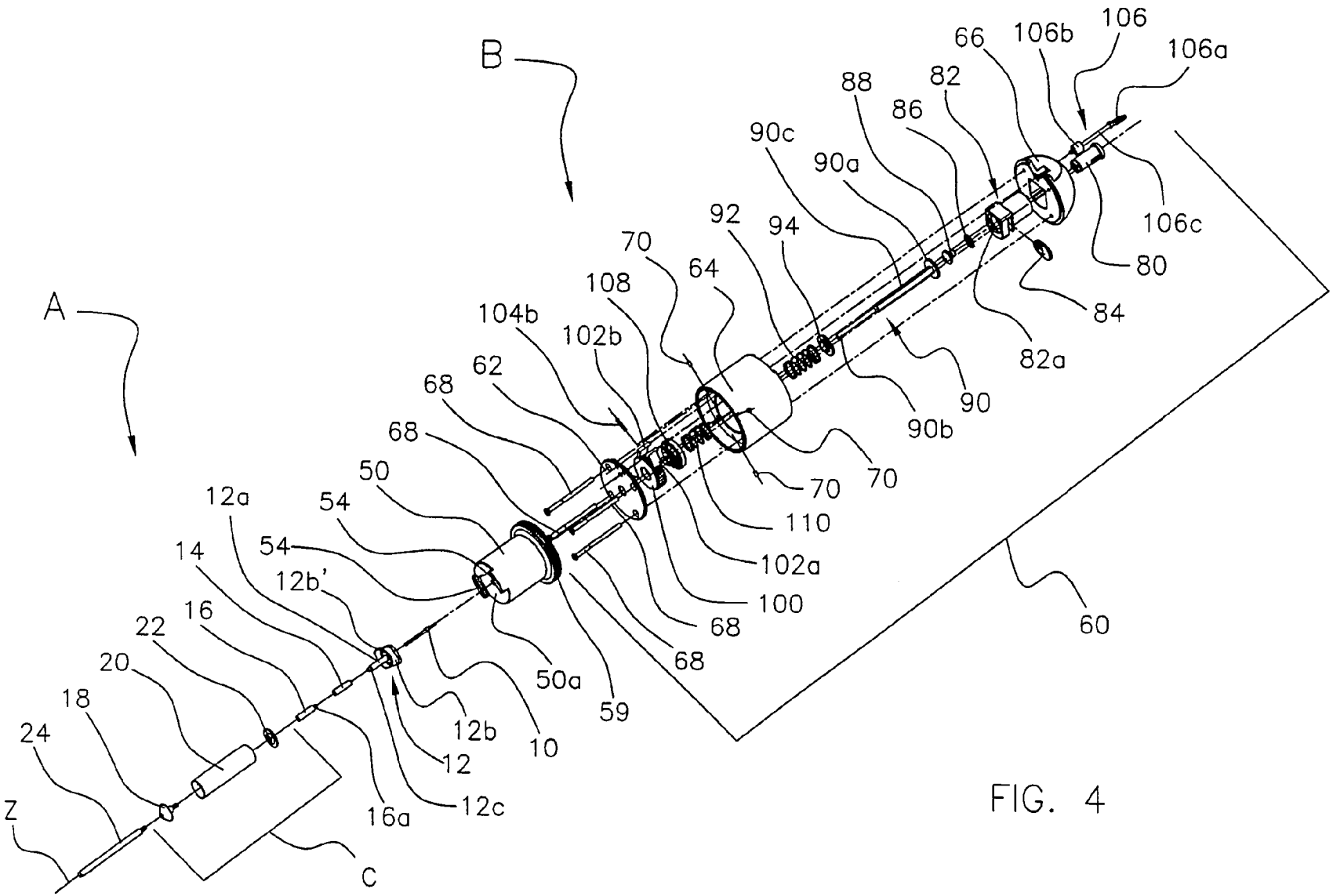
FIG. 4 shows an exploded perspective view of both the barrel plug and hand ratcheting wrench assemblies of FIGS. 2A and 3A.
Figure 5D:
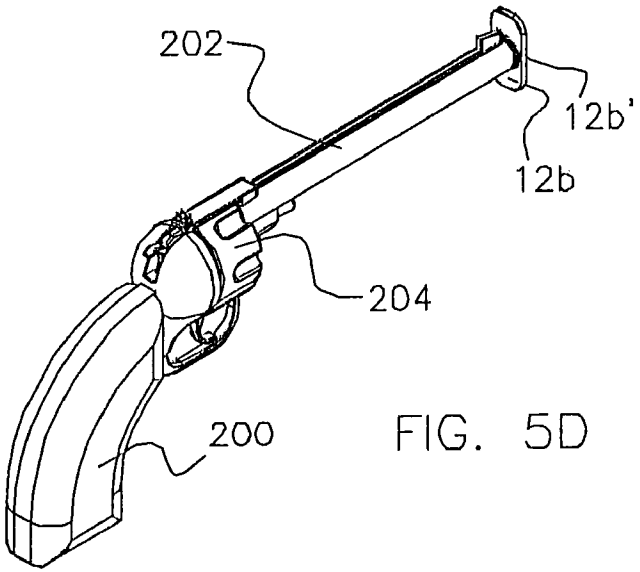
FIGS. 5A through 5E show a back, a side, a front and two perspective views, respectively, of a revolver with a barrel plug assembly in accordance with aspects of the present invention installed in the barrel.
Figure 5E:
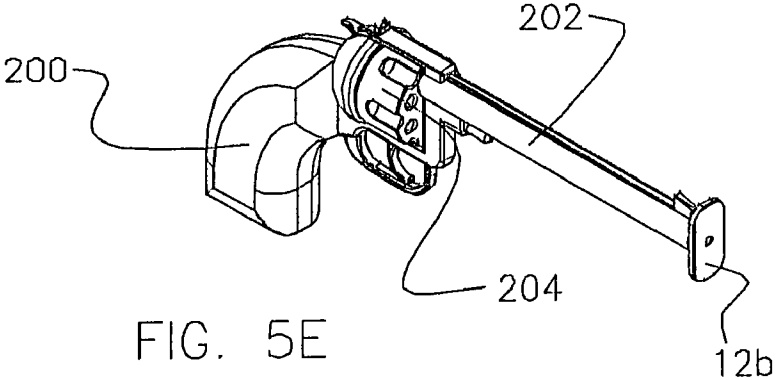
Figure 5C:
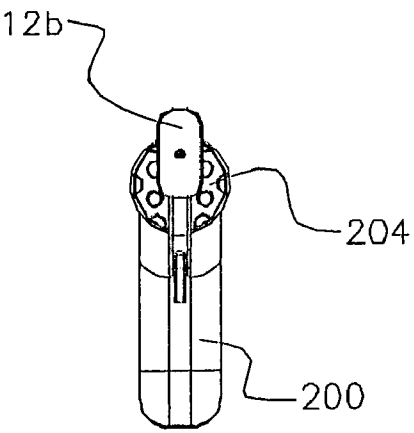
Figure 5B:
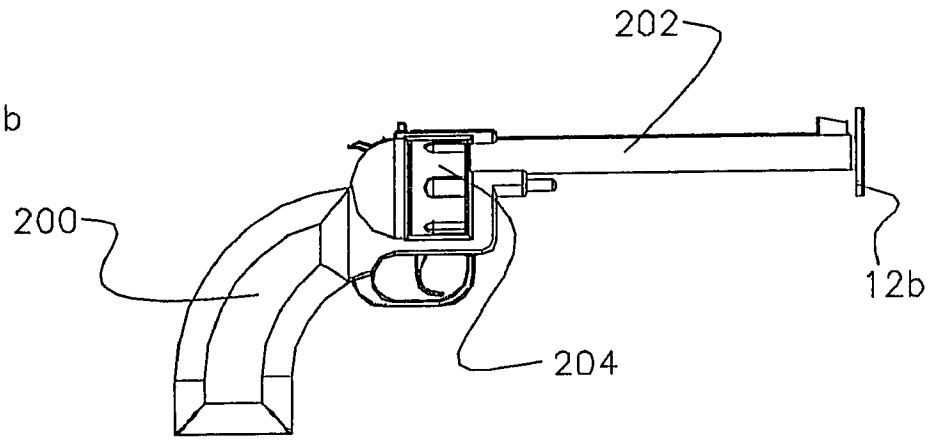
Figure 5A:
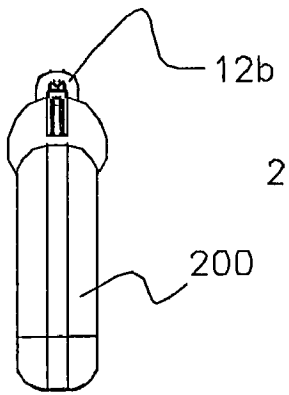
Figure 6E:
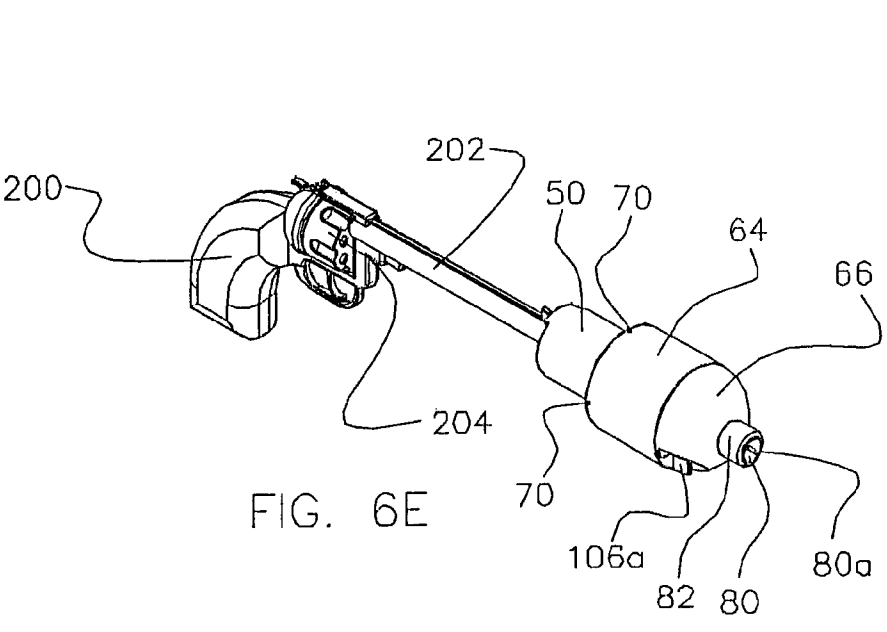
FIGS. 6A through 6E show the corresponding views, respectively, of FIGS. 5A through 5E with a wrench assembly attached to the barrel plug assembly in accordance with aspects of the present invention.
Figure 6C:
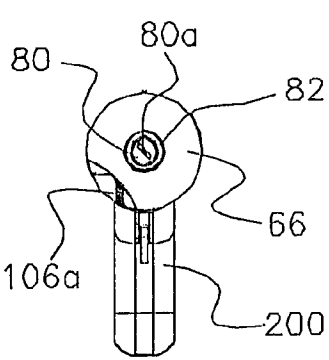
Figure 6B:
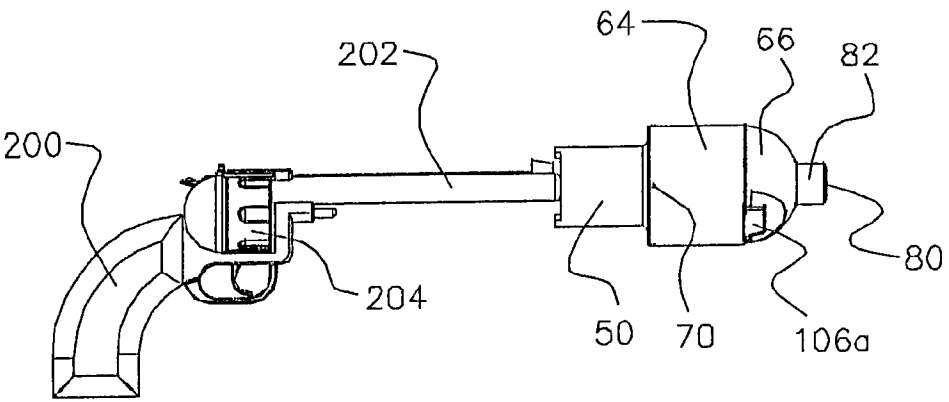
Figure 6D:
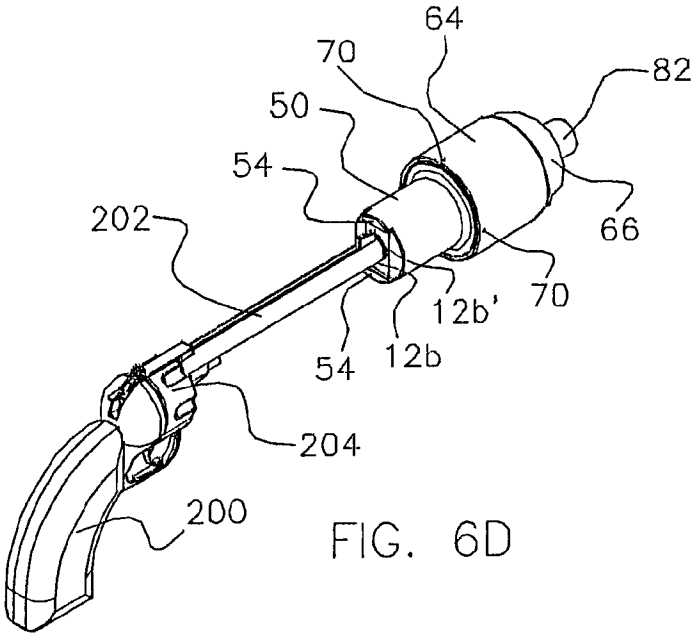
Figure 6A:
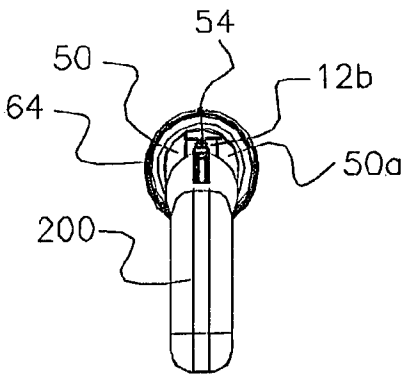
Figure 8B:
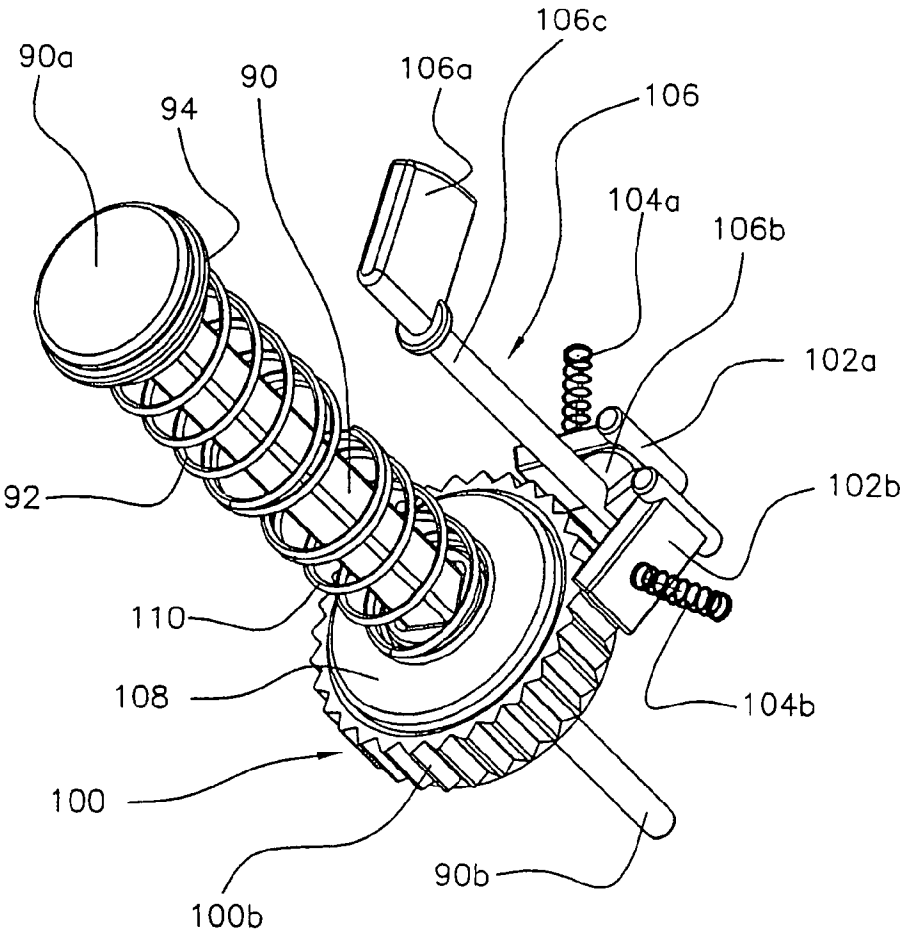
FIG. 8B is an unexploded perspective view showing selected internal elements (including an extraction rod, and a slip clutch and ratchet assembly) of the hand ratcheting wrench assembly of FIG. 3A.
Figure 8A:
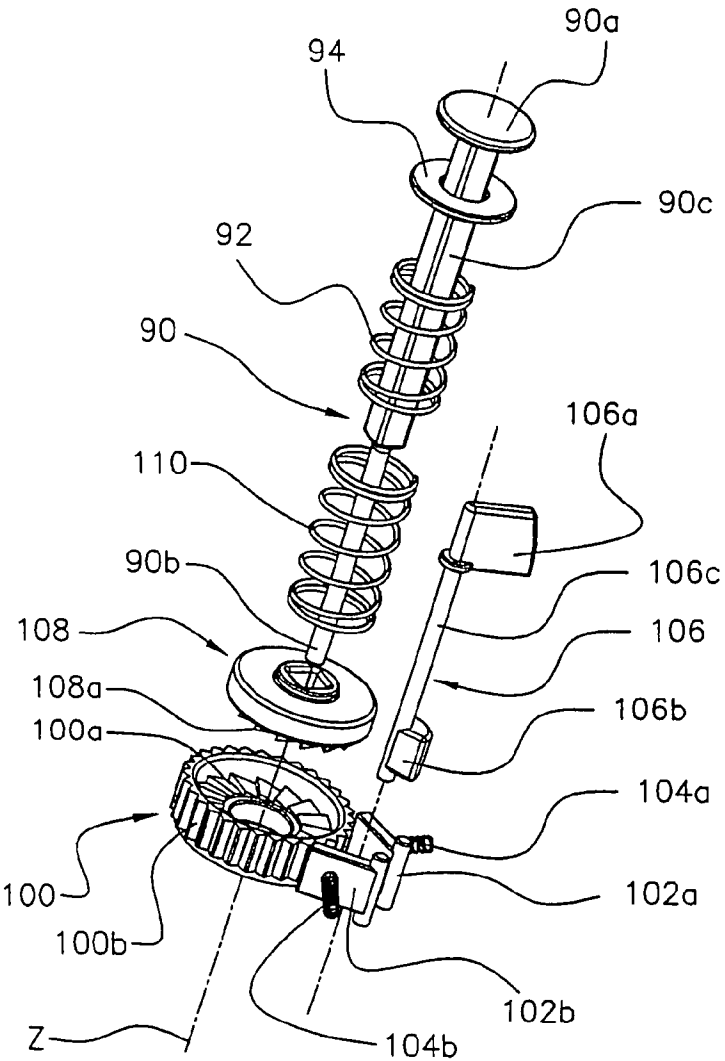
FIG. 8A is an exploded perspective view showing selected internal elements (including an extraction rod, and a slip clutch and ratchet assembly) of the hand ratcheting wrench assembly of FIG. 3A.

With reference to FIGS. 3A, 8A and 8B, a ratchet assembly portion of the wrench assembly B allows the extraction rod 90 to be rotated in either direction using a continuous ratcheting motion to selectively tighten or loosen the bolt 10. The ratchet assembly includes a ratchet slip clutch gear 100, a pair of ratchet arms 102*a* and 102*b*, corresponding ratchet arm compression springs 104*a* and 104*b*, and a ratchet arm selector 106.

The ratchet slip clutch gear 100 has a triangular spur gear tooth pattern/profile 100*b* that symmetrically raps around its outer diameter. The two ratchet arms 102*a* and 102*b* are positioned opposing one another about the outer diameter of the gear 100. The arms 102*a* and 102*b* are pivotally secured at one end between the inner retaining disk 62 and a fixed interior lateral ledge or annular lip within the housing drum 64. The opposing ends of the arms 102*a* and 102*b* are biased toward the toothed outer diameter of the gear 100 by their respective compression springs 104*a* and 104*b*. The two ratchet arms 102*a* and 102*b* are positioned so that they line up/mate with the triangular spur gear's tooth root diameter and edge profile.

The ratchet arm selector 106 includes a lever 106*a* and a cam 106*b* at opposing ends of a shaft 106*c*. The selector 106 is arranged such that the lever 106*a* extends out of the housing cap 66 for manipulation by the user. By flipping the lever 106*a* 90 degrees to the left and/or right, a user selectively rotates the shaft 106*c* (which is preferably parallel with and radially offset from the z axis) and the cam 106*b* at the opposing end. The cam 106*b* is positioned between the arms 102*a* and 102*b* and the gear 100 such that in accordance with the manipulation of the lever 106*a* the cam 106*b* effects the disengagement of one of the ratchet arms from the gear 100 and effects the engagement of the other ratchet arm with the gear 100. Depending upon its rotational position, the cam 106*b*, acting against the biasing force of one of the springs 104*a* and 104*b*, deflects one of the arms 102*a* and 102*b* about its pivot point while the undeflected arm is urged or pressed into engagement with the gear 100 by the biasing force of it its compression spring.

In the following context, clockwise and counterclockwise refer to the direction of rotation when viewed from the housing cap 66 end of the wrench assembly B. When the lever 106*a* is flipped so that the arm 102*a* is pressed against the gear 100 by the spring 104*a* and the arm 102*b* is deflected by the cam 106*b*, a continuous ratcheting motion (i.e., continuous rotation in alternating directions) applied to the upper portion 60 of the wrench assembly B advances the gear 100 counterclockwise. This is because, on the counterclockwise stroke applied to the upper portion 60, the housing drum 64 and the inner retaining disk 62 rotate counterclockwise, and the arm 102*a* moving therewith engages the teeth 100*b* on the outer diameter of the gear 100 and the gear 100 is rotated counterclockwise. On the clockwise stroke applied to the upper portion 60, the housing drum 64 and the inner retaining disk 62 rotate clockwise, but the arm 102*a* moving therewith does not engage the teeth 100*b* on the outer diameter of the gear 100 and the gear 100 does not rotate. Rather, on the clockwise stroke, the arm 102*a* is free to deflect about its pivot point against the biasing force of the spring 104*a*, and so, the teeth 100*b* on the outer diameter of the gear 100 deflect the arm 102*a* (rather than engage with it) as the arm 102*a* is dragged across them.

Conversely, when the lever 106*a* is flipped so that the arm 102*b* is pressed against the gear 100 by the spring 104*b* and the arm 102*a* is deflected by the cam 106*b*, a continuous ratcheting motion applied to the upper portion 60 of the wrench assembly B advances the gear 100 clockwise. This is because, on the clockwise stroke applied to the upper portion 60, the housing drum 64 and the inner retaining disk 62 rotate clockwise, and the arm 102*b* moving therewith engages the teeth 100*b* on the outer diameter of the gear 100 and the gear 100 is rotated clockwise. On the counterclockwise stroke applied to the upper portion 60, the housing drum 64 and the inner retaining disk 62 rotate counterclockwise, but the arm 102*b* moving therewith does not engage the teeth 100*b* on the outer diameter of the gear 100 and the gear 100 does not rotate. Rather, on the counterclockwise stroke, the arm 102*b* is free to deflect about its pivot point against the biasing force of the spring 104*b*, and so, the teeth 100*b* on the outer diameter of the gear 100 deflect the arm 102*b* (rather than engage with it) as the arm 102*b* is dragged across them.

Please note, FIG. 8B shows the cam 106*b* deflecting the arm 102*a* thereby preventing it from engaging with the teeth 100*b* on the outer diameter of the gear 100. Conversely, the position of the cam 106*b* as shown in FIG. 8B does not deflect the arm 102*b* thereby enabling it to selectively engage, depending on the direction of the stroke applied, with the teeth 100*b* on the outer diameter of the gear 100.

As described later herein, the rotation of the gear 100 and/or a torque associated therewith is transferred and/or applied to the extension rod 90 via a slip clutch output drive gear 108. Accordingly, in this manner, the wrench's ratchet assembly allows a user to drive the extraction rod 90 in either selected direction of rotation using a continuous ratcheting motion to selectively tighten or loosen the bolt 10.

The combination of the ratchet slip clutch gear 100 and the slip clutch output drive gear 108 serves as a torque limiter to prevent an over application of torque to the bolt 10 which may potentially damage the same. The gear 100 preferably has a symmetrically oriented, beveled, angular, inner radial, gear tooth pattern 100*a* on its transaxial face that abuts and mates with the transaxial face of gear 108 having a corresponding gear tooth pattern 108*a*. The transaxial faces of the gears 100 and 108 are compressed or biased together by a slip clutch compression spring 110. Preferably, the spring 110 is a standard compression spring that is compressed between a fixed interior lateral ledge or annular lip within the housing drum 64 and the slip clutch output drive gear 108. The compressed spring 110 urges or presses the slip clutch gear 100 and the slip clutch output drive gear 108 together with a predetermined compressive force. When the compressive force is exceeded, the gears 100 and 108 will slip and rotate independently from one another.

The drive gear 108 preferably has a square or otherwise keyed center hole which receives a square or otherwise keyed portion 90*c* of the extraction rod 90 such that they are rotationally fixed with respect to one another. Therefore, the rotational movement and/or torque experienced by the drive gear 108 is transferred to the extraction rod 90, and in turn, the bolt 10 when it is engaged with the extraction rod 90.

When the barrel plug assembly A is being installed in a gun barrel's bore by applying a continuous ratcheting motion to the upper portion 60 of the wrench assembly B with the selector lever 106*a* in the bolt tightening position, both the ratchet slip clutch gear's and the slip clutch output drive gear's teeth 100*a* and 108*a*, respectively, will slip when a maximum allowable torque is exceeded. Accordingly, the torque applied to or experienced by the bolt 10 is limited. The limited torque will prevent the bolt 10 from being over tightened, which could undesirably damage the bolt's threads 10*a*, bushing 10*c* and/or head 10*b*. Additionally, a user installing the safety device will not have to worry if the barrel plug assembly A has been properly secured in the gun barrel's bore. This is because when the gears 100 and 108 slip between each other, they preferably make a clicking sound to indicate that the proper torque has been applied. This clicking sound is made when the mating, symmetrically oriented, beveled, and angular inner radial gear teeth 100*a* and 108*a*, slip and slide over their 90 degree vertical ledges, located along the apex of each of the gear's teeth.

When a user applying a continuous ratcheting motion to the upper portion 60 of the wrench assembly B with the selector lever 106*a* in the bolt loosening position to remove the barrel plug assembly A from the gun barrel's bore, the ratchet slip clutch gear 100 and the slip clutch output drive gear 108 automatically lock together. The automatic locking is achieved by using a 90 degree vertical ledge, located along the apex of each of the symmetrical oriented, beveled, and angular inner radial gear teeth. Essentially, the abutting transaxial faces of the gears 100 and 108 have mating ramped teeth 100*a* and 108*a* which form a one-way slip clutch which will not slip when the relative rotation therebetween is in a first direction, and which will slip if a predetermined torque is exceeded when the relative rotation is in a second direction opposite the first. When the gears 100 and 108 are rotated relative to one another such that their teeth 100*a* and 100*b* lock together or will not slip, the user will be able to apply as much torque/force as is needed to loosen the bolt 10 and stretch or elongate the barrel plug assembly A.

As already stated, in the center of the slip clutch output drive gear 108 is a square hole that is used as a guide and mount for the extraction rod 90. This square hole is designed to slide over the extraction rod's square body 90*c*. The two parts preferably have a slip fit tolerance, so that the extraction rod 90 can slide easily through the slip clutch output drive gear's square hole, with very little backlash/rotational movement. The slip clutch output drive gear 108 is used to transfer the output torque from the hand ratcheting wrench's slip clutch to the extraction rod 90, while still allowing the extraction rod 90 to be extended and retracted from the hand ratcheting wrench assembly B.

Preferably, the hand ratcheting wrench B is used to install and remove the barrel plug assembly A, and without the hand ratcheting wrench B, the barrel plug assembly A cannot be properly installed or removed. When a user wants to install the barrel plug assembly A to secure their gun, they preferably perform the following steps.

The barrel plug assembly's flanged bolt-retaining plug 12 is slid into the lower handle mount 50 located on the bottom of the hand ratcheting wrench B, as shown in FIGS. 1A–1D . The appropriate key is inserted into the lock cylinder 80 located on the top of the housing cap 66, and the lock cylinder housing 82 is unlocked by turning the lock cylinder 80 so that the locking lever 84 is disengaged from the slot 66*a* of the housing cap 66. The user then push the lock cylinder housing 82 and the lock cylinder 80 down into the housing cap 66 so that the extraction rod 90 is pushed into the extended position and engages with the bolt 10. The user now turns the lock cylinder 80 so that the locking lever 84 will engage with slot 66*b* of the housing cap 66, and preferably removes the key. This locks the extraction rod 90 in the extended position. Note: when the above steps are properly completed, the extraction rod 90 will engage with the bolt 10.

The user inserts the barrel plug assembly A, that is now connected to the hand ratcheting wrench B, into the muzzle of the gun. Preferably, the plug assembly A is inserted all the way until the flange 12 is flush with the end of the barrel, as shown in FIGS. 6A–6E. If not already there, the ratchet arm selector 106 is shifted into the locking or tightening position using the selector lever 106*a*. While holding the lower handle mount 50 in one hand, the upper portion 60 of the wrench B is rotate using a continuous ratcheting motion of alternating clockwise and counterclockwise strokes. The ratchet assembly makes the installation of the barrel plug assembly A quick and easy.

The ratcheting rotation of the upper portion 60 of the wrench assembly B advances the ratchet slip clutch gear 100 in the clockwise direction thereby applying rotation and/or torque to the slip clutch output drive gear 108, which, in turn, is transferred to the extraction rod 90 and the bolt 10 engaged therewith. The rotation of the bolt 10 pulls the threaded rear compression base 16 (and the screw on expansion tube adapter 18, if used) and the flanged bolt-retaining plug 12 together thereby longitudinally compressing the expansion tube 14 (and the slide-on expansion tube 20, if used). Longitudinally compressing the expansion tubes 14 and 20 causes them to radially bulge and/or push against the walls in which each is contained, be it the gun barrel bore or the inner bore of the slide-on expansion tube 20. In this manner, the plug assembly A becomes wedged inside of the gun's barrel, thereby securing the barrel plug assembly A in the gun barrel. Preferably, the user continues ratcheting the wrench assembly B until the biasing force of the compression spring 110 is overcome and the gears 100 and 108 slip past one another. A "clicking" sound is heard when the two gears 100 and 108 slip and rotate between each other signifying that the barrel plug assembly A has been fully tightened. If a clicking sound is not heard from the slip clutch gears 100 and 108, the plug assembly A has not been fully tightened and ratcheting of the wrench B should continue.

Once fully tightened, the user reinserts the key in the lock cylinder 80 (if not still in the same), and unlocks the lock cylinder housing 82 by turning the lock cylinder 80 so that the locking lever 84 disengages from slot 66*b* of the housing cap 66. The user then allows the compression spring 92 to push the extraction rod 90 up into the retracted position and the lock cylinder housing 82 and the lock cylinder 80 into the undepressed position. Turning the lock cylinder 80 so that the locking lever 84 engages with slot 66*a* of the housing cap 66 and removing the key, locks the push lock in the undepressed position and the extraction rod 90 in the retracted position to prevent tampering and/or use by an unauthorized individual.

The hand ratcheting wrench assembly B may now be slid away from the flanged bolt-retaining plug 12 while the plug assembly A remains properly installed in the barrel, as shown in FIGS. 5A–5E and 7. Preferably, the entire installation procedure can be easily completed in less than one (1) minute.

When an authorized user wants to remove the barrel plug assembly A from a gun's barrel to operate the gun or otherwise, they preferably perform the following steps.

The lower handle mount 50, located on the bottom of the hand ratcheting wrench assembly B, is slid onto the flange 12*b* of the flanged bolt-retainer plug 12 (as shown in FIGS. 6A–6E), the appropriate key is inserted into the lock cylinder 80, located on the top of the housing cap 66, and the lock cylinder housing 82 is unlocked by turning the lock cylinder 80 so that the locking lever 84 is disengaged from the slot 66*a* of the housing cap 66. The user then push the lock cylinder housing 82 and the lock cylinder 80 down into the housing cap 66 so that the extraction rod 90 is pushed into the extended position and engages with the bolt 10. The user now turns the lock cylinder 80 so that the locking lever 84 will engage with slot 66*b* of the housing cap 66, and preferably removes the key. This locks the extraction rod 90 in the extended position. Note: when the above steps are properly completed, the extraction rod 90 will engage with the bolt 10.

If not already there, the ratchet arm selector 106 is shifted into the unlocking or loosening position using the selector lever 106*a*. While holding the lower handle mount 50 in one hand, the upper portion 60 of the wrench B is rotate using a continuous ratcheting motion of alternating clockwise and counterclockwise strokes. The ratchet assembly makes the removal of the barrel plug assembly A quick and easy.

The ratcheting rotation of the upper portion 60 of the wrench assembly B advances the ratchet slip clutch gear 100 in the counterclockwise direction thereby applying rotation and/or torque to the slip clutch output drive gear 108, which, in turn, is transferred to the extraction rod 90 and the bolt 10 engaged therewith. The rotation of the bolt 10 pushes the threaded rear compression base 16 (and the screw on expansion tube adapter 18, if used) and the flanged bolt-retaining plug 12 apart thereby longitudinally stretching the expansion tube 14 (and the slide-on expansion tube 20, if used). Longitudinally stretching the expansion tubes 14 and 20 causes them to radially contract. In this manner, the plug assembly A becomes unwedged from inside of the gun's barrel, thereby freeing it to be readily removed from the same. Preferably, the plug assembly A is slid or pulled from the gun barrel plug while still connected to the hand ratcheting wrench assembly B.

Preferably, to remove the hand ratcheting wrench B from the extracted gun barrel plug assembly A, the user reinserts the key in the lock cylinder 80 (if not still in the same), and unlocks the lock cylinder housing 82 by turning the lock cylinder 80 so that the locking lever 84 disengages from slot 66*b* of the housing cap 66. The user then allows the compression spring 92 to push the extraction rod 90 up into the retracted position and the lock cylinder housing 82 and the lock cylinder 80 into the undepressed position. Turning the lock cylinder 80 so that the locking lever 84 engages with slot 66*a* of the housing cap 66 and removing the key, locks the push lock in the undepressed position and the extraction rod 90 in the retracted position to prevent tampering and/or use by an unauthorized individual.

The hand ratcheting wrench assembly B may now be slid away from the flanged bolt-retaining plug 12 thereby separating it from the plug assembly A. Preferably, the entire removal or de-installation procedure can be easily completed in less than one (1) minute.

Preferably, the extraction rod 90 is formed or made from a suitably strong, hard, rigid and/or durable material, such as, hardened steel or other metal or like material. The bolt engaging end of the extraction rod's shaft and/or the socket 90*b* preferably have a 0.140 inch outer diameter. When the hand ratcheting wrench assembly B is used to install the barrel plug assembly A, the small diameter socket 90*b* is extend out past the hand ratcheting wrench assembly's lower handle mount 50. It centers itself within the very confined space of the flanged bolt-retaining plug 12 and mates up with the head 10*b* of the bolt 10. The extraction rod's socket 90*b* and 0.140 inch outer diameter shaft preferably have close slip fit tolerances. These close slip fit tolerances enable the flanged bolt-retaining plug 12 and the bolt 10 to mate/slide together with the extraction rod's socket 90*b* and 0.140 inch outer diameter shaft, with very little backlash or deviation from the center line or z axis.

In relationship to the socket 90*b*, the extraction rod 90 has a, preferably, flat 0.750 inch outer diameter, flange or head 90*a* that is located on the opposite end. This flange or head 90*a* mates with and/or abuts the bottom end 82*a* of the lock cylinder housing 82. The flange or head 90*a* permits the extraction rod 90 to rotate and move up and down within the hand ratcheting wrench assembly B, while securing the rod 90 so that it cannot be forcibly removed from the assembly B.

The lock cylinder housing 82 is used as a plunger, which when pushed into the housing cap 66 extends the extraction rod 90, as shown in FIGS. 3C and 3D. Its position controls what position the extraction rod 90 is in. The housing is used to hold and align the lock cylinder 80 and the extraction rod 90, while the entire push lock assembly moves/slides up and down within the housing cap 66. The lock cylinder 80 is used to manually lock the lock cylinder housing 82 in the selected position. When the lock cylinder housing 82 is in the "up" or undepressed position, it preferably protrudes above the housing cap 66, indicating that the extraction rod 90 is in the retracted position, as shown in FIG. 3B. When the lock cylinder housing 82 is in the "down" or depressed position, it is preferably flush with the top of the housing cap 66, indicating that the extraction rod 90 is in the extended position, as shown in FIGS. 3C and 3D. The lock cylinder housing 82 preferably has a recessed blind hole located in the bottom end 82*a* thereof so that the extraction rod's flat 0.750 inch outer diameter flange or head 90*a* will fit into the same. The mating of these two parts keeps the extraction rod 90 in alignment while the extraction rod 90 is rotating and moving up and down within the hand ratcheting wrench assembly B.

Preferably, the housing cap 66 has the two parallel 90 degree slots 66*a* and 66*b* located in an outside wall of the housing cap's lock cylinder housing's bore. These two slots are used as locking points for the lock cylinder housing 82. The lock cylinder housing 82 and the extraction rod 90 can be locked into the undepressed and the retracted positions, respectively, when the locking lever 84 is slid/rotated into the housing cap's upper slot 66*a*, located relatively nearer the top of the cap's curved surface. The lock cylinder housing 82 and the extraction rod 90 can be locked into the depressed and the extended positions, respectively, when the locking lever 84 is slid/rotated into the housing cap's lower slot 66*b*, located relatively nearer the flat bottom of the housing cap 66. The location and arrangement of the locking slots 66*a* and 66*b* ensure that when the push lock is properly lock into one of the two positions, the extraction rod 90 has been fully retracted or extended.

Preferably, the housing cap 66 and housing drum 64 are ergonomically shaped such that when the user places the hand ratcheting wrench assembly B in their hand, the palm of their hand will comfortably and easily mold around the curved top of the housing cap 66 while their fingers rest comfortably on the cylindrical surface of the housing drum 64. This ergonomic fit enables the user to quickly, comfortably, and with a minimal amount of force, selectively install or remove the barrel plug assembly A from any gun barrel.

The hand ratcheting wrench assembly's housing drum 64 isolates the upper portion 60 from the lower handle mount 50. Both of these subassemblies are isolated so that when any of the subassembly's parts are compressed, moved or rotated, these parts will not adversely affect the operation of the other parts. An example of this is when the lock cylinder housing 82 and the extraction rod 90 are locked in depressed and the extended positions, respectively, the compression spring 92 will be compressed. If the housing drum 64 is not compartmentalized, the extraction rod 90 and the compression spring 92 will push against the already compressed slip clutch compression spring 110. This increase and/or variation in the spring's 110 compression force, will adversely affect the operation of the slip clutch, by increasing the amount of torque that is required to make the slip clutch slip. The compressed slip clutch compression spring 110 should always exert the same compression force on the ratchet slip clutch gear 100 and the slip clutch output drive gear 108 so that they will be forced together and always slip at a constant preset torque.

The housing drum 64 is the main rotating body of the hand ratcheting wrench assembly B. This housing drum 64 fastens onto and rotates around the lower handle mount 50, while holding and/or housing all of the subassemblies of the wrench assembly B. The housing drum 64 enables the hand ratcheting wrench assembly B to have overall rotational movement with respect to the lower handle mount 50, and at the same time, enable its internal components/subassemblies to move in determined independent linear and rotational directions.

Figure 9A:
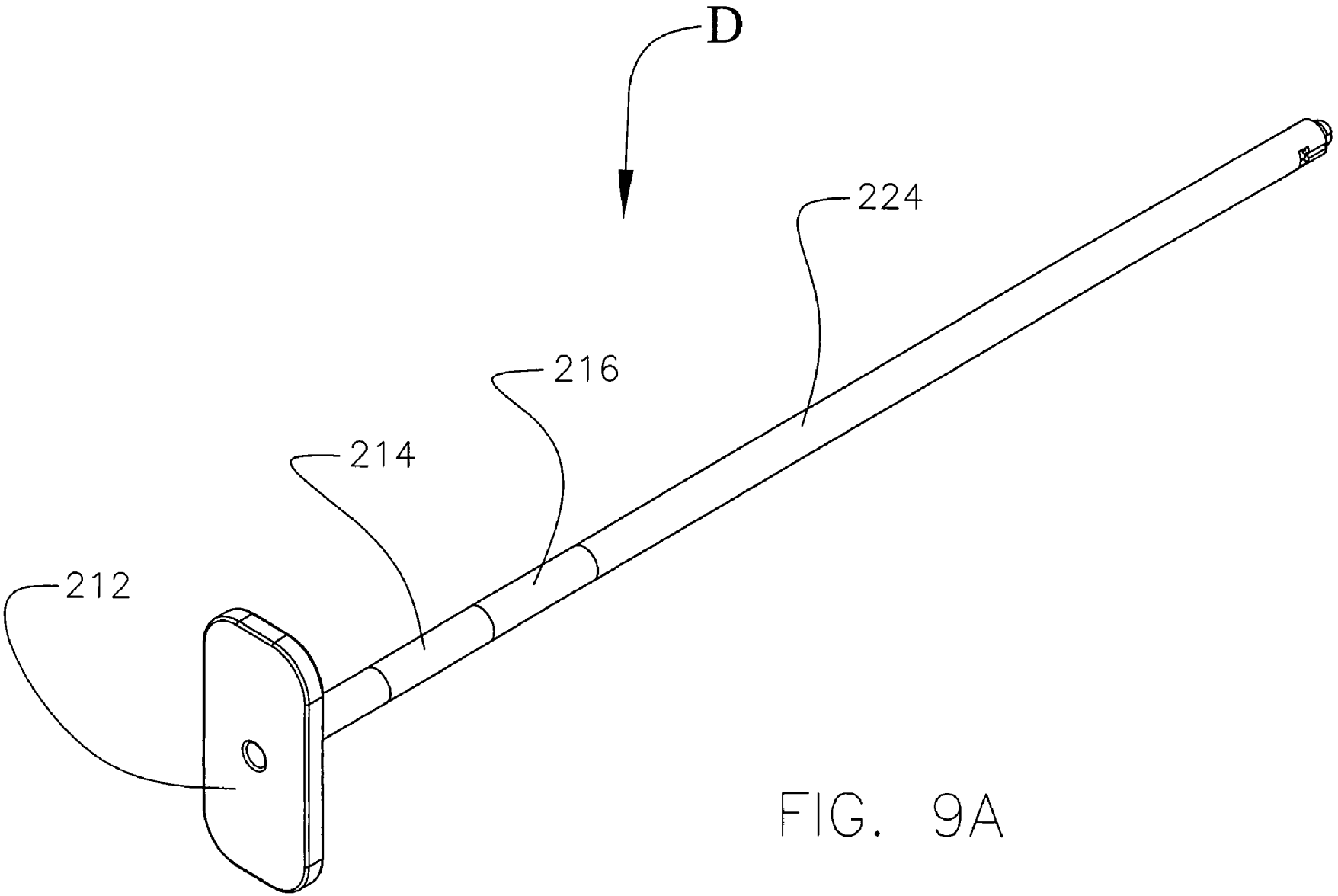
FIG. 9A is a perspective view of an alternative barrel plug assembly.

With reference to FIG. 9A, an alternative barrel plug assembly D that includes an adjustable portion is shown. The adjustable barrel plug assembly allows the owner of the gun barrel safety lock to use the same lock with different guns having different barrel lengths. The alternative barrel plug assembly can be used with the hand ratcheting wrench assembly B described above.

Figure 9B:
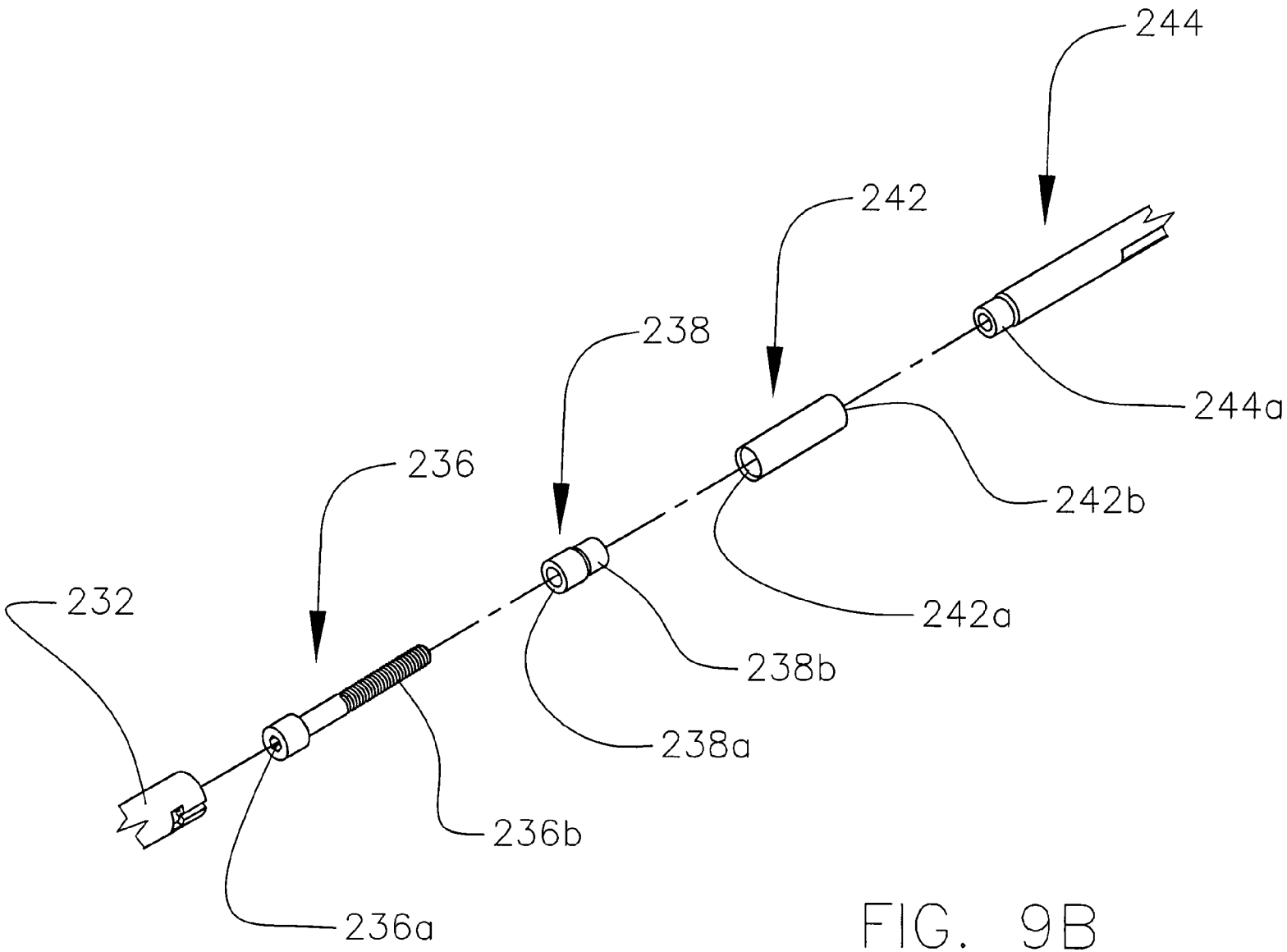
FIG. 9B is an exploded view of a portion of the barrel plug assembly of FIG. 9A.
Figure 9C:
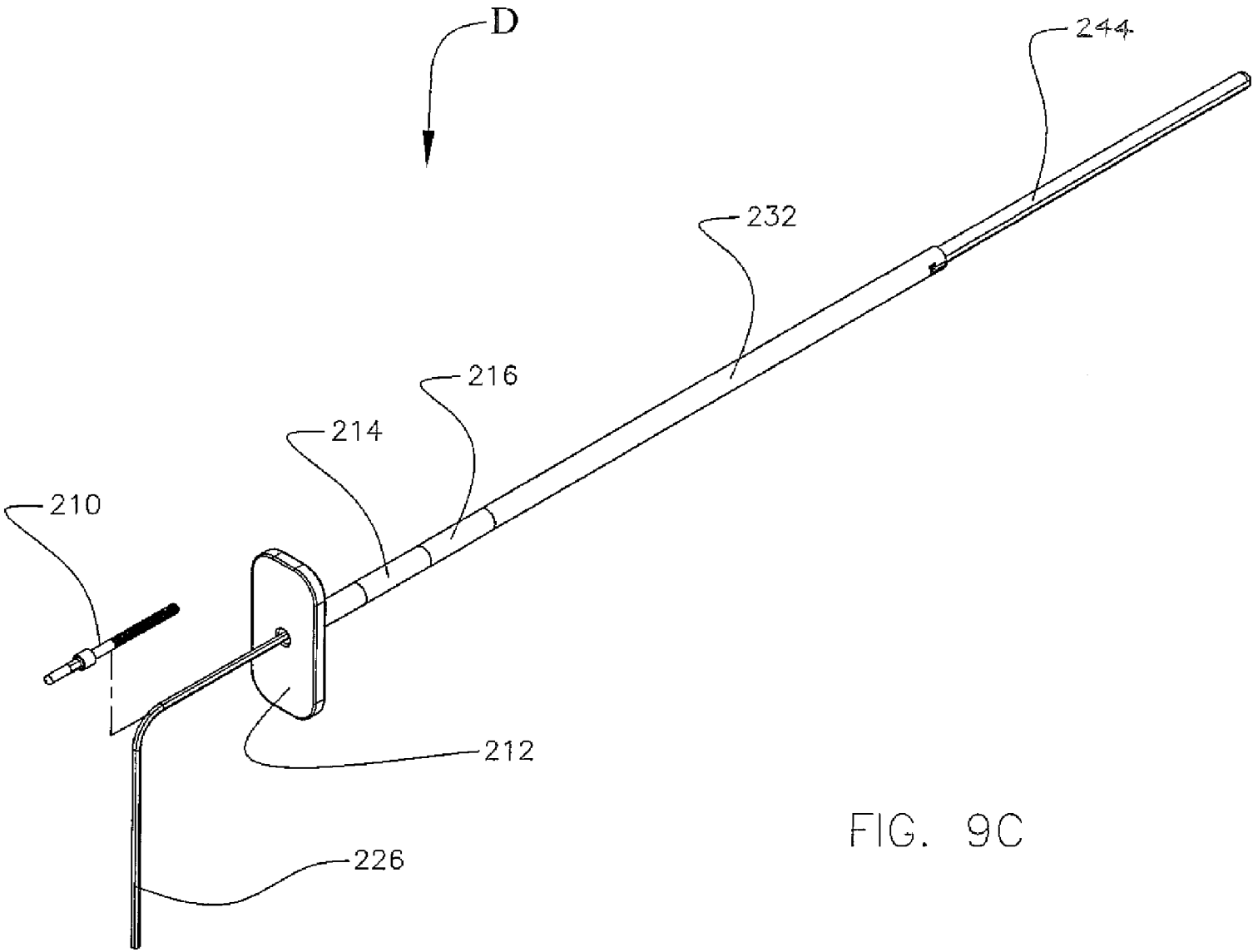
FIG. 9C is a perspective view of the barrel plug assembly of FIG. 9A in an extended position having a key inserted into the barrel plug assembly.

The adjustable barrel plug assembly D includes a flanged bolt-retaining plug 212 that is similar to the bolt-retaining plug 12 described above. The bolt-retaining plug 212 is attached to an expansion tube 214, which is similar to the expansion tube 14 described above. The expansion tube 214 attaches to a threaded rear compression base 216, which is similar to the threaded rear compression tube 16 described above. A bolt 210 (FIG. 9C) is selectively received inside the bolt retaining plug 212, the expansion tube 214 and the rear compression base 216 to draw the rear compression base and the plug 212 towards one another similar to bolt 10, which is described above.

An extension rod assembly 224 attaches to the rear compression base 216 opposite the expansion tube 214. The extension rod assembly 224 includes a tubular plug extension 232 that receives components to allow adjustment of the length of the extension rod assembly 224. Referring to FIG. 9E, the tubular plug extension 232 also includes a threaded end 232*a* that is received by the rear compression base 216. The tubular plug extension 232 includes a central bore 234 that runs substantially the entire longitudinal length of the tubular plug extension. The central bore 234 receives a bolt 236, which in one embodiment is a female hexagon bolt. The bolt includes an opening 236*a* that can receive a key 226, which will be described in more detail below. The opening 236*a* in one embodiment receives a 1/16" hex Allen wrench, which acts as the key. The outer diameter of the bolt 236 is such that the bolt can easily slide within the bore 234. The bolt 236 also includes a shank 236*b* having a threaded portion.

An annular sliding bolt retaining plug 238 receives the shank 236*b* of the bolt 236. The sliding bolt retaining plug 238 has a flat bearing surface 238*a* (FIG. 9B) that is perpendicular to the longitudinal axis of the sliding bolt retaining plug and the tubular plug extension 232. The flat bearing surface 238*a* acts as a contact and compression point for the bolt 236 in that the bolt can spin against the bearing surface. The sliding bolt retaining plug 238 also includes a tapered portion 238*b* spaced longitudinally from the flat bearing surface 238*a*. The tapered end 238*b* of the sliding bolt retaining plug attaches to a sliding expansion tube 242.

The sliding expansion tube 242 is hollow to receive the shank 236*b* of the bolt 236. The sliding expansion tube is made from a petroleum resistant polymer synthetic elastomer material that has good compressive and/or stretching characteristics. The outer diameter of the sliding expansion tube 242 is such that it can freely move within the bore 234 and it can deform such that a friction fit between the inner surface of the bore 234 and the sliding expansion tube can be achieved when a compressive force is exerted on the sliding expansion tube. The sliding expansion tube 242 includes a first tapered end 242*a* that receives the tapered portion 238*b* of the sliding bolt retaining plug 238. Because of the small size of the components, each tapered portion advantageously increases the surface area of contact between the sliding expansion tube 242 and the sliding bolt retaining plug 238 to provide a greater area for bonding between the components. The sliding expansion tube 242 also includes a second tapered end 242*b* opposite the first tapered end 242*a*. The second tapered end 242*b* is received in a portion of a sliding extension rod 244.

The sliding extension rod 244 includes a tapered end 244*a* that is received by the second tapered end 242*b* of the sliding expansion tube 242. Because of the small size of the components, each tapered portion advantageously increases the surface area of contact between the sliding expansion tube 242 and the sliding extension rod 244. The sliding extension rod 244 also includes a threaded bore 244*b* that selectively receives the threaded shank 236*b* of the bolt 236. The outer diameter of the sliding extension rod 244 is such that it can freely move within the bore 234 of the tubular plug extension 232. Preferably, the sliding extension rod 244, along with the other components that are received in the bore 234, are designed with a slip fit tolerance that substantially reduces any misalignment or binding when the internal components are moved back and forth within the bore 234.

Both the attachment between the sliding bolt retaining plug 238 and the sliding expansion tube 242 and the attachment between the sliding extension rod 244 and the sliding expansion tube 242 are described as connections between tapered portions. Nevertheless, it is appreciated that the attachment between the components can be in any conventional manner. For example, the components can each include corresponding notched patterns that allow the components to connect by way of a mechanical interference.

Figure 9D:
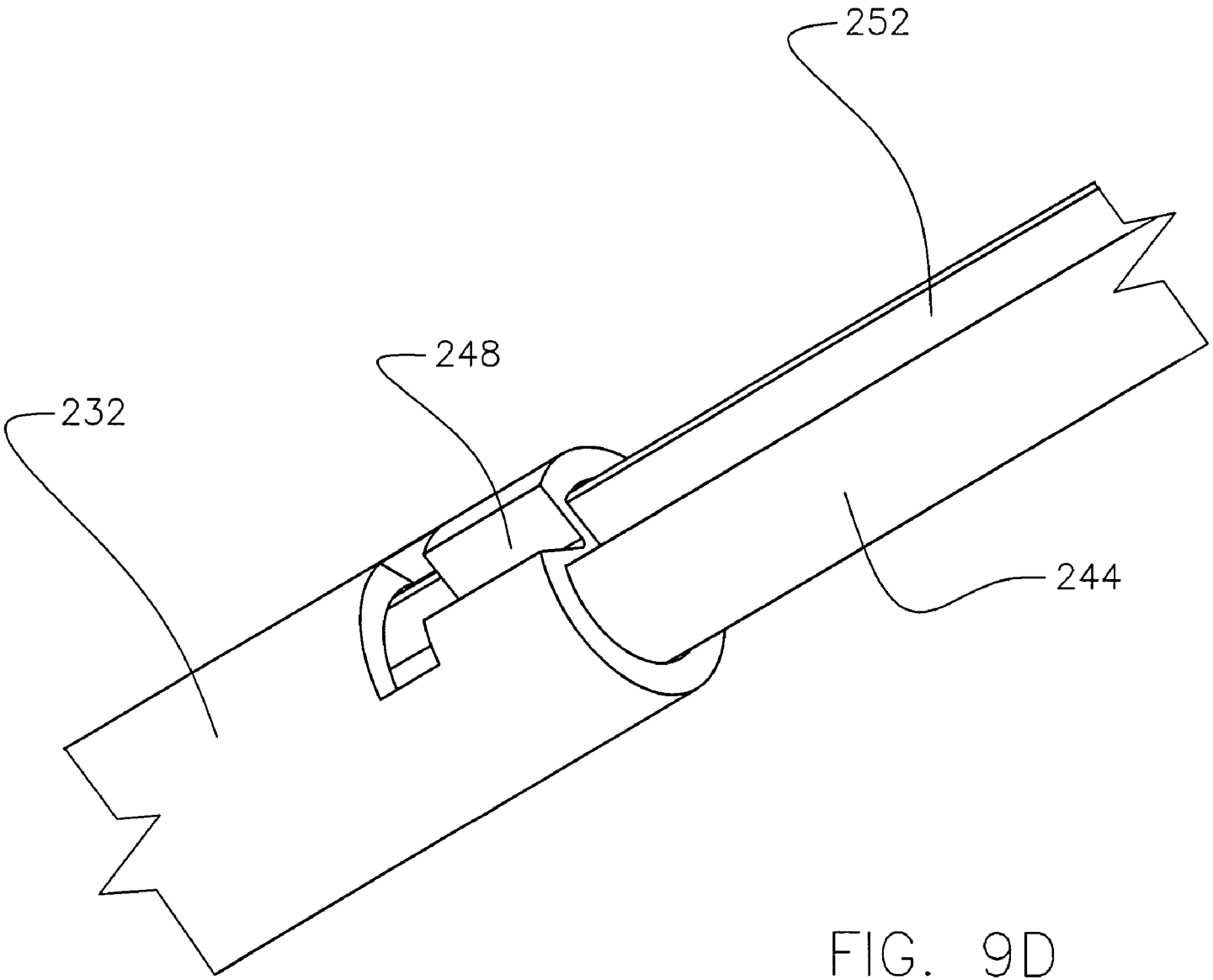
FIG. 9D is a close-up view of a guide tab and a guide slot of the barrel plug assembly of FIG. 9A.
Figure 9E:
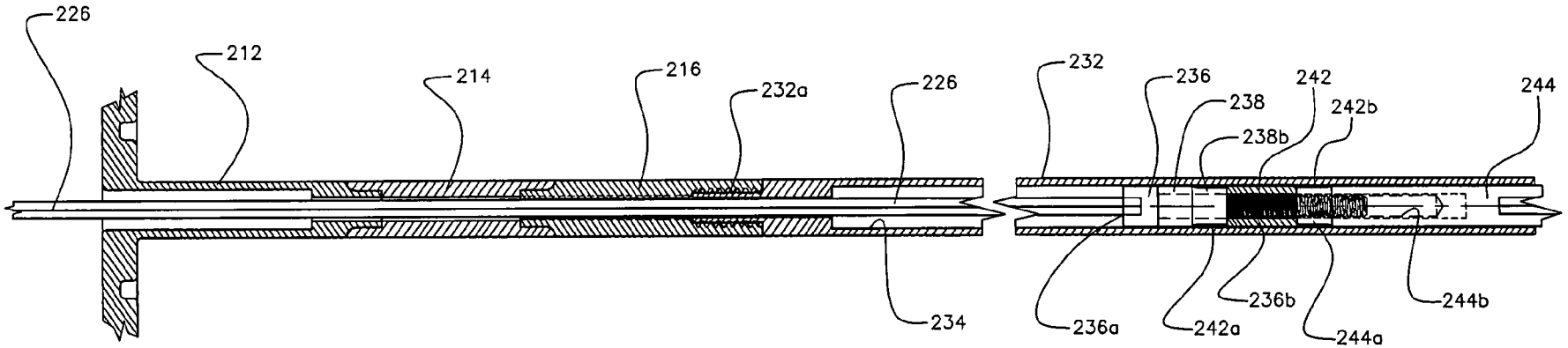
FIG. 9E is a partial cross-section of the barrel plug assembly of FIG. 9A, (with some internal features being represented by a dashed line.)

As more clearly visible in FIG. 9D, the sliding extension rod 244 also includes a guide slot 252 that receives a guide tab 248 formed at or near the distal end of the tubular plug extension 232. In the embodiment depicted, the guide slot 252 and the guide tab 248 are V-shaped. The sliding extension rod 244 can freely slide in and out of the bore 234 of the tubular plug extension 232 without the guide tab 248 causing interference. The guide tab 248 provides a mechanical interference between the sliding extension rod 244 and the tubular plug extension 232 so that the rod 244 does not rotate when the bolt 236 is tightened.

To adjust the length of the barrel plug assembly D, a bolt 210, which in one embodiment is a male hexagon key bolt similar to the bolt 10 described above, is removed from the assembly. The key 226 is inserted into the assembly D and is received by the appropriately shaped opening 236*a* of the bolt 236. When tightened, the bolt 236 contacts the bearing surface 238*a* of the sliding bolt retaining plug 238 pushing the bolt longitudinally toward the sliding extension rod 244. Meanwhile, the bolt 236 draws the sliding extension rod 244 towards the sliding bolt retaining plug 238. Accordingly, the sliding expansion tube 242 is compressed and deformed to engage the inner surface of the tubular plug extension 232. The sliding expansion tube 242 is advantageously tubular in configuration to provide a larger contact or gripping area when compressed, especially when compared to conventional O-rings.

Figure 10B:
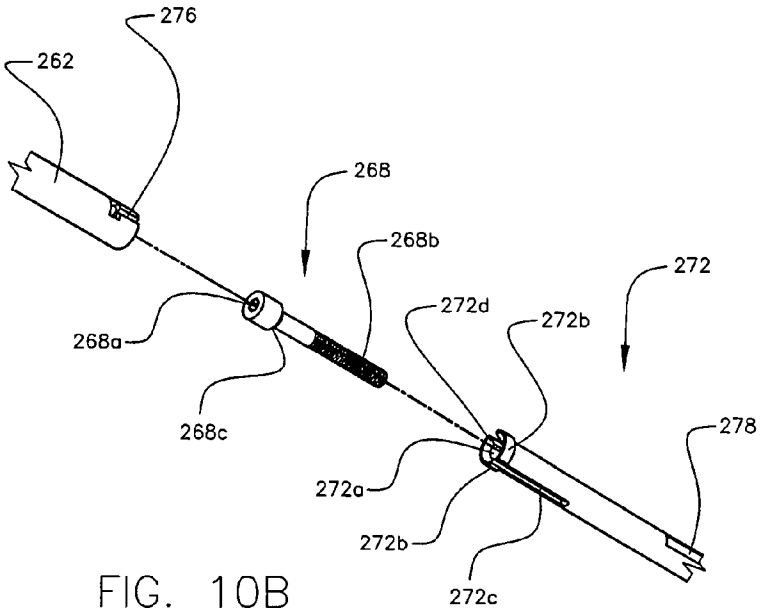
FIG. 10B is a close-up view of section A of FIG. 10A.
Figure 10A:
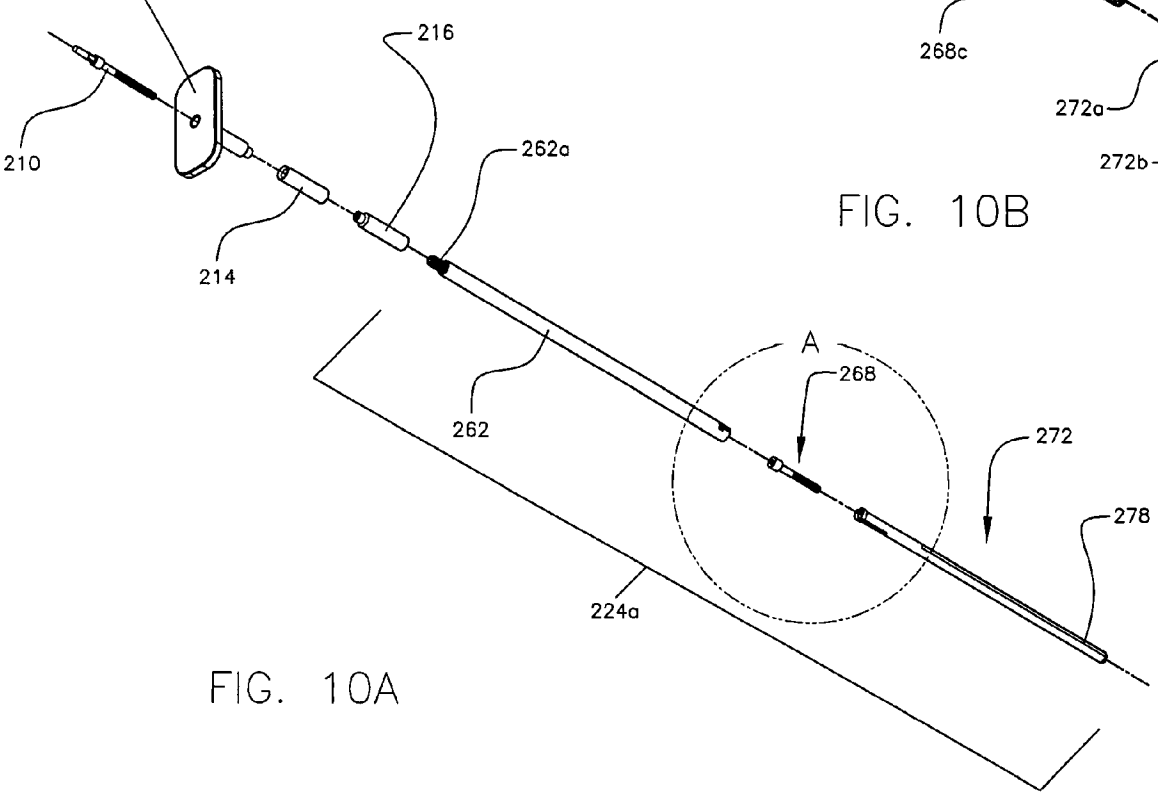
FIG. 10A is an exploded perspective view of another alternative barrel plug assembly.

With reference to FIG. 10A, an alternative adjustable extension rod assembly 224*a* is shown. In FIG. 10A, the bolt 210, the plug 212, the expansion tube 214 and the rear compression base 216 have been described above.

Figure 10C:
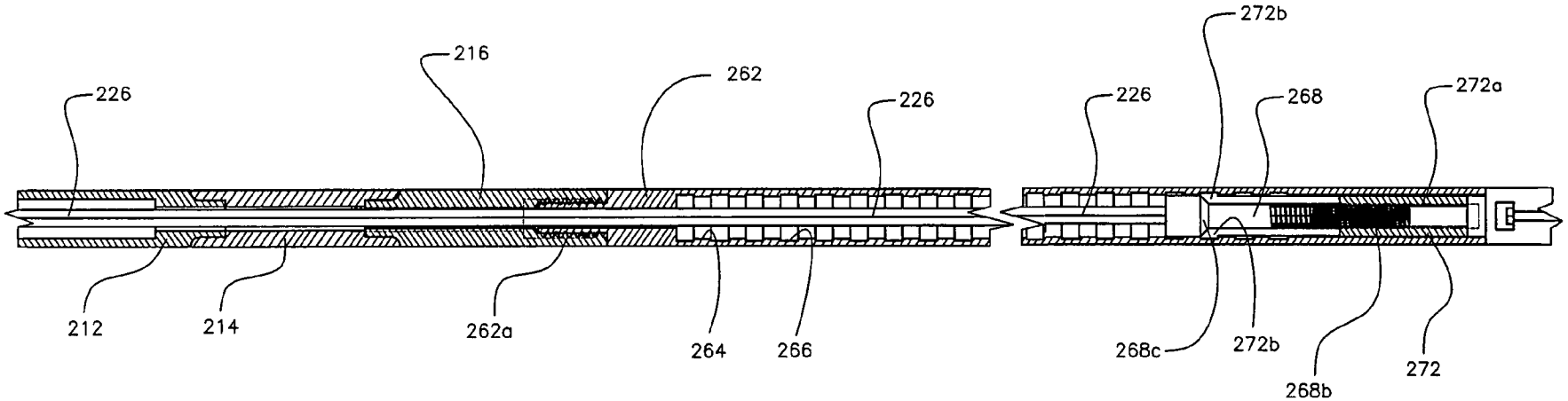
FIG. 10C is an assembled partial cross-section of the barrel plug assembly of FIG. 10A, (with some internal features being represented by a dashed line.)

The adjustable extension rod assembly 224*a* includes a tubular plug extension 262 that receives components to allow the length of barrel plug assembly to adjust. The tubular plug extension 262 includes a threaded end 262*a* that is received by the rear compression base 216. Referring to FIG. 10C, the tubular plug extension 262 includes a central bore 264 that runs substantially the entire longitudinal length of the tubular plug extension. The central bore 264 includes a plurality of annular notches 266 formed throughout the central bore. The annular notches 266 can be equally spaced from one another.

The central bore 264 receives a bolt 268, which in one embodiment is a female hexagon bolt. The bolt includes an opening 268*a* that can receive the key 226. The opening 268*a* in one embodiment receives a 1/16" hex Allen wrench. The outer diameter of the bolt 268 is such that the bolt can easily slide within the bore 264 without falling into one of the notches 266. The bolt 268 also includes a shank 268*b* that includes threads and a tapered portion 268*c* at the transition from a head of the bolt 268 to the shank 268*b*.

The bore 264 of the tubular plug extension 262 receives a sliding extension rod 272. The sliding extension rod 272 includes a threaded bore 272*a* that receives the shank 268*b* of the bolt 268. The sliding extension rod also includes an expandable end that can selectively engage an inner surface of the tubular plug extension 262. In the embodiment depicted in FIGS. 10A–10C, the sliding extension rod includes a flanged lip 272*b* at a first end. The outer diameter of the flanged lip 272*b* can adjust so that the sliding extension rod 272 can move within the bore 264 without the flanged lip getting caught or falling into one of the notches 266. The sliding extension rod 272 also includes two slits 272*c* (only one visible) formed in the flanged lip 272*b* and a portion of the rod 272 near the flanged lip. The slits 272*c* are formed parallel to the longitudinal axis of the sliding extension rod 272 and allow for the radial dimension of the flanged lip 272*b* to change. The sliding extension rod 272 also includes a tapered surface 272*d* formed around the opening of the threaded bore 272*a* and the flared lip 272*b*. The tapered surface 272*d* cooperates with the tapered portion 268*c* of the bolt 268 such that when the bolt is tightened into the threaded bore 272*a* of the sliding extension rod, the tapered portion 268*c* forces the flanged lip 272*b* radially outward so that the flanged lip moves into one of the notches 266 and engages the inner surface of the tubular plug extension.

The sliding extension rod 272 also includes a guide slot 278 similar to the guide slot 252 described above. The tubular plug extension 262 also includes a guide tab 276 similar to the guide tab 248 described above. The guide slot 278 and the guide tab 276 cooperate to restrict the rotational movement of the sliding extension rod 272 when the bolt 268 is rotated.

To adjust the length of the extension rod assembly 224*a*, the bolt 210 is removed and the key 226 is inserted into the assembly. The key is used to tighten or loosen the bolt 268 in the threaded bore 272*a*. When the bolt 268 is tightened, the tapered portion 268*c* of the bolt forces the flanged lip 272*b* of the sliding extension rod 272 radially outward toward the inner surface of the tubular plug extension 262 into one of the grooves 266. When the bolt 268 is loosened, the flanged lip 272*b* moves radially towards the longitudinal axis and out of one of the grooves 266, to allow for adjustment.

Figure 11A:
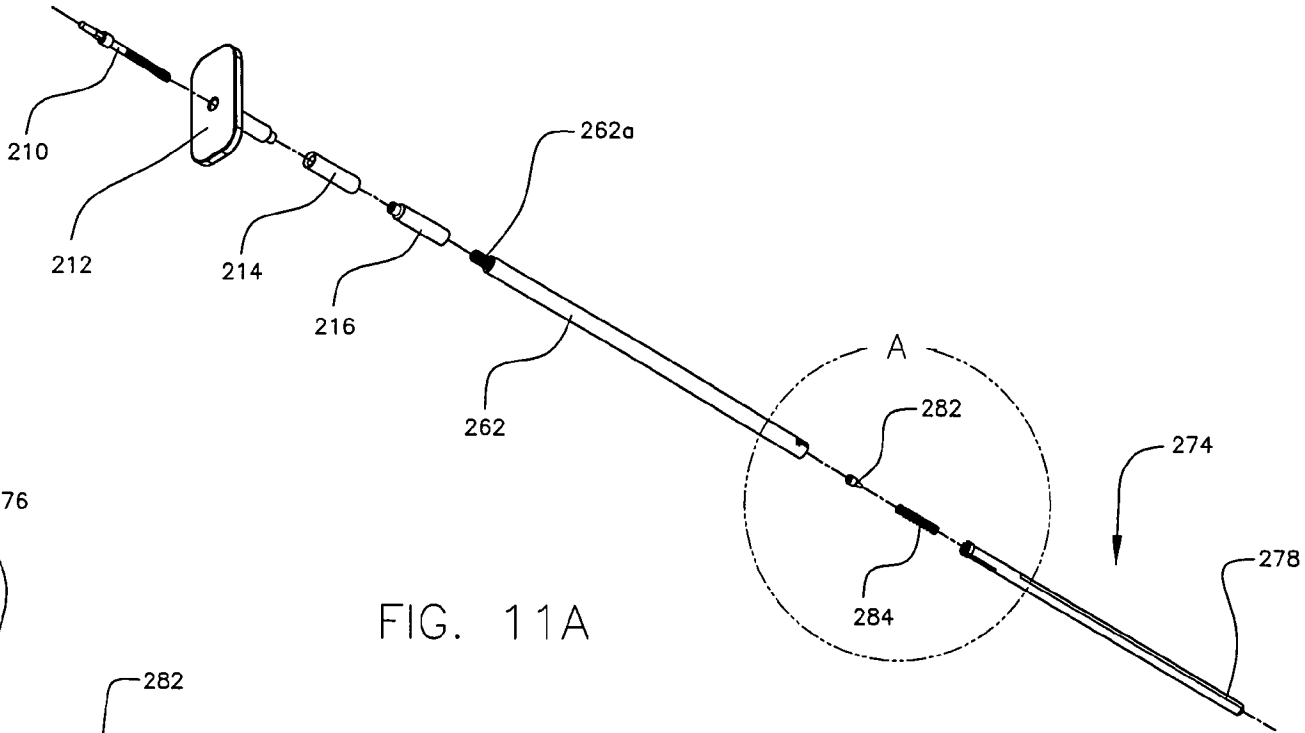
FIG. 11A is an exploded perspective view of another alternative barrel plug assembly.
Figure 11B:
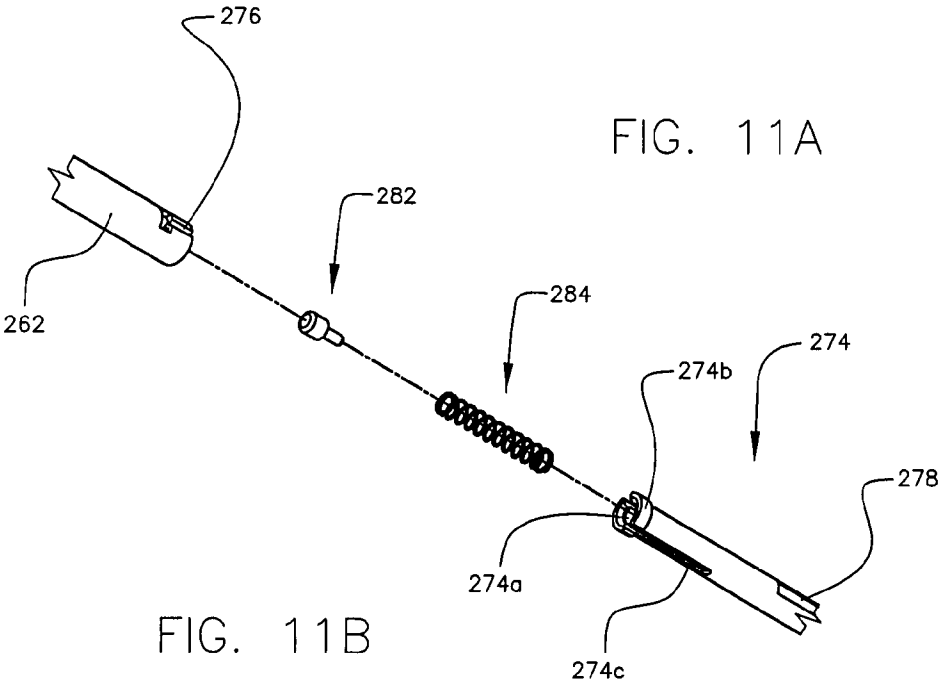
FIG. 11B is a close-up view of section A of FIG. 11A.

With reference to FIGS. 11A and 11B, an alternative to the abovementioned adjustable extension rod assembly is shown. In this embodiment, the tubular plug extension 262 is similar to and can be the same as the tubular plug extension described with reference to FIGS. 10A–10C. Also, the sliding extension rod 274 is similar to the sliding extension rod 272 described above in that it includes a bore 274*a*, a flanged lip 274*b*, and a pair of slits 274*c*. In this embodiment, however, the bore 274*a* preferably is not threaded. Also, as more clearly visible in FIG. 11C, the sliding extension rod 274 includes an inner flange 274*d*.

Figure 11C:
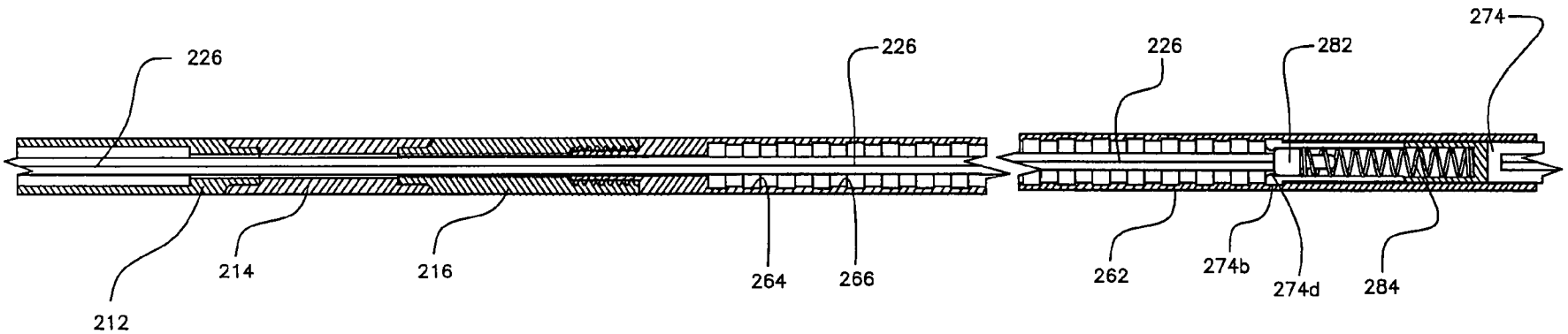
FIG. 11C is an assembled partial cross-section of the barrel plug assembly of FIG. 11A, (with some internal features being represented by a dashed line).

The bore 274*a* receives a sliding plunger wedge 282 and a spring 284. The spring 284 biases the sliding plunger wedge 282 towards the inner flange 274*d*. As seen in FIG. 11C, the key 226 can be inserted into the assembly to move the sliding plunger wedge 282 longitudinally away from the inner flange 274*d*. With the sliding plunger wedge 282 moved away from the inner flange 274*d*, the flanged lip 274*b* moves toward the longitudinal axis of the sliding extension rod 274 and the tubular plug extension 262, thus away from the notches 266. With the flanged lip 274*b* retracted inwardly, the sliding extension rod 274 can be adjusted. The key 226 can then be removed and the spring 284 biases the sliding wedge plunger 282 towards the inner flange 274*d*, thus radially biasing the flanged lip 274*b* into one of the notches 266.

Figures 12A, 12B:
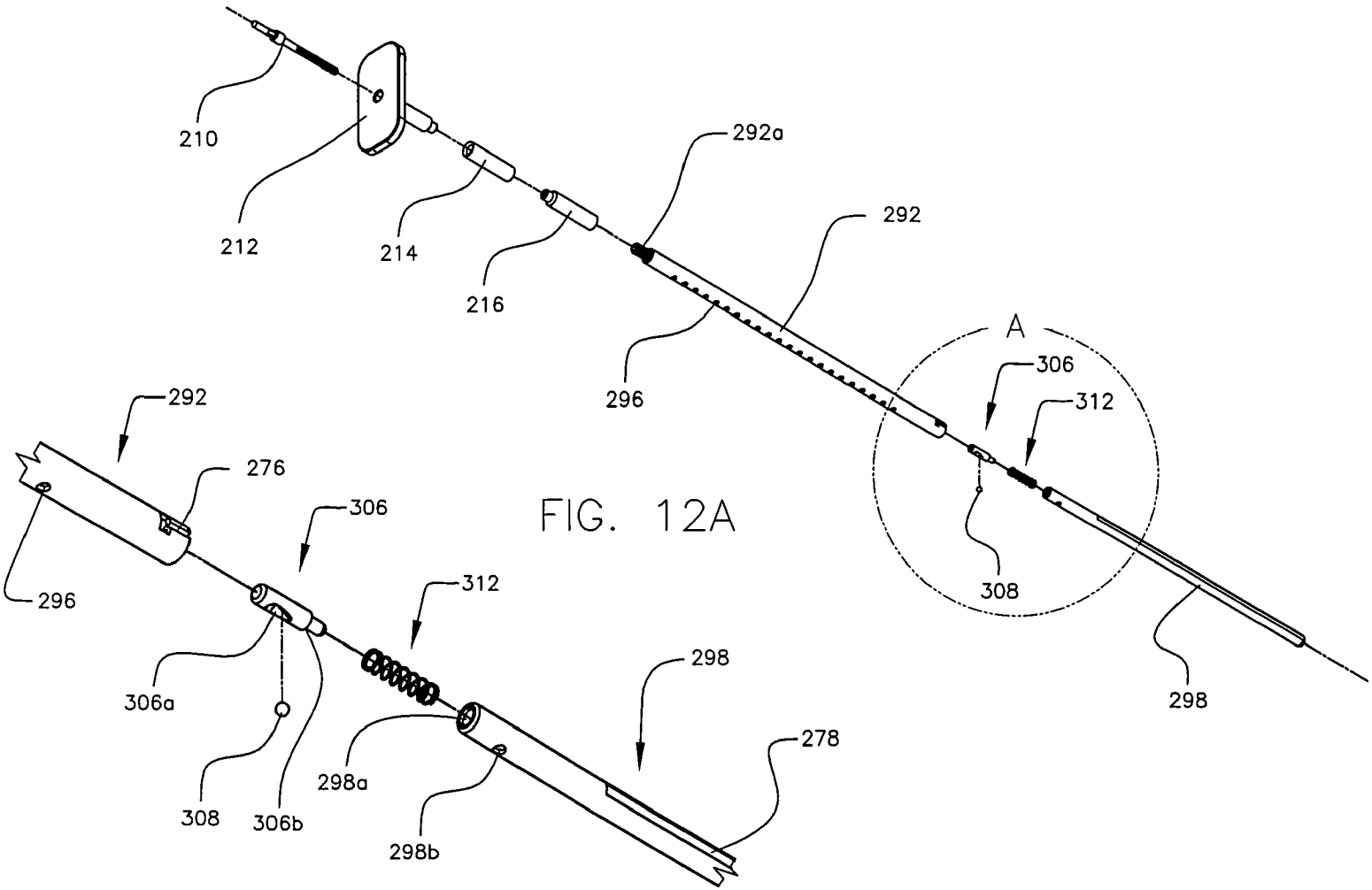
FIG. 12A is an exploded perspective view of another alternative barrel plug assembly.
FIG. 12B is a close-up view of section A of FIG. 12A.
Figure 12C:
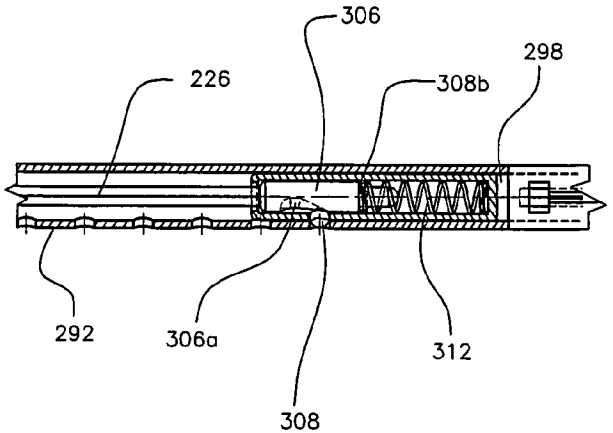
FIG. 12C is an assembled partial cross-section of the barrel plug assembly of FIG. 12A, (with some internal features being represented by a dashed line.)
Figure 12C:
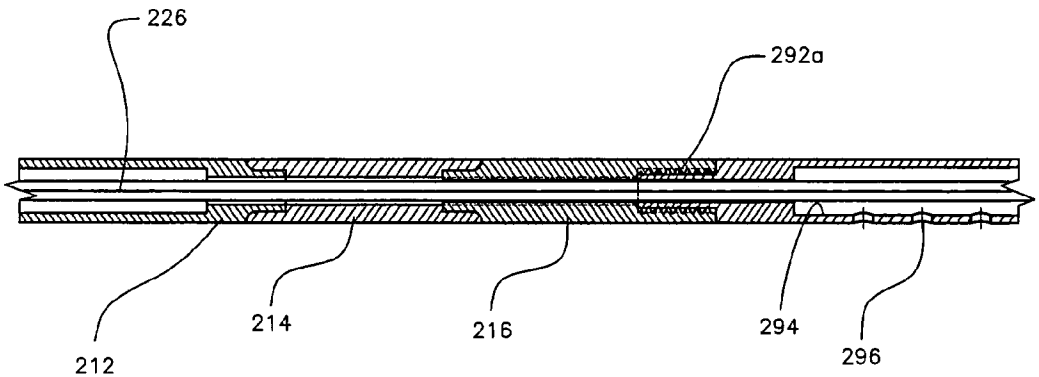

With reference to FIGS. 12A–12C, another alternative of an adjustable barrel plug assembly is disclosed. In FIG. 12A, the bolt 210, the plug 212, the expansion tube 214 and the rear compression base 216 have been described above. Also, a guide tab 276 and a guide slot 278 can be provided to keep openings 296 in alignment with opening 298*b*.

The adjustable barrel plug assembly also includes a plug extension tube 292 having a longitudinal bore 294 (FIG. 12C) and a plurality of openings 296 extending through a wall of the plug extension tube 292. The longitudinal bore 294 is similar to the bore 234 described with reference to FIG. 9E, in that the bore is smooth and runs substantially the entire length of the plug extension tube 292. The openings 296 can be evenly spaced and aligned with one another, as shown in FIG. 12A. The plug extension tube 292 also includes a threaded end 292*a* that is received by the rear compression base 216. The plug extension tube 292 receives a sliding extension rod 298.

The sliding extension rod 298 includes a longitudinal bore 298*a* that receives a sliding bearing plunger wedge 306, a ball 308 and a biasing member 312. The sliding extension rod 298 also includes an alignment opening 298*b* extending through the rod that communicates with the longitudinal bore 298*a*.

The sliding bearing plunger wedge 306 includes a ramp 306*a* formed in a side. In one embodiment, the ramp 306*a* is a half tear-drop shape. The sliding bearing plunger wedge 306 also includes a bearing surface 306*b* that bears against the biasing member 312, which in the embodiment depicted is a coil spring.

The ball 308 is moves on the ramp 306*a* of the sliding bearing plunger wedge 306. The ball 308 is dimensioned to fit through the alignment opening 298*b* and partially into, preferably one-quarter of the way into a corresponding opening 296 in the plug extension tube 292. To adjust the length of the barrel plug assembly, the key 226 is inserted into the assembly to bias the sliding bearing plunger wedge 306 towards a distal end of the assembly. With the sliding bearing plunger wedge 306 biased towards the distal end of the assembly, the ball 308 can move on the ramp 306*a* axially toward the longitudinal axis of the sliding extension rod 298. With the ball 308 displaced toward the longitudinal axis, the sliding extension rod 298 can be moved in relation to the plug extension tube 292. Releasing the sliding bearing plunger wedge 306 results in the ball 308 traveling on the ramp 306*a* radially away from the longitudinal axis and towards the opening 298*b*. The sliding bearing plunger wedge 306 retains the ball 308 in the openings 298*b* and 296.

Figure 13A:
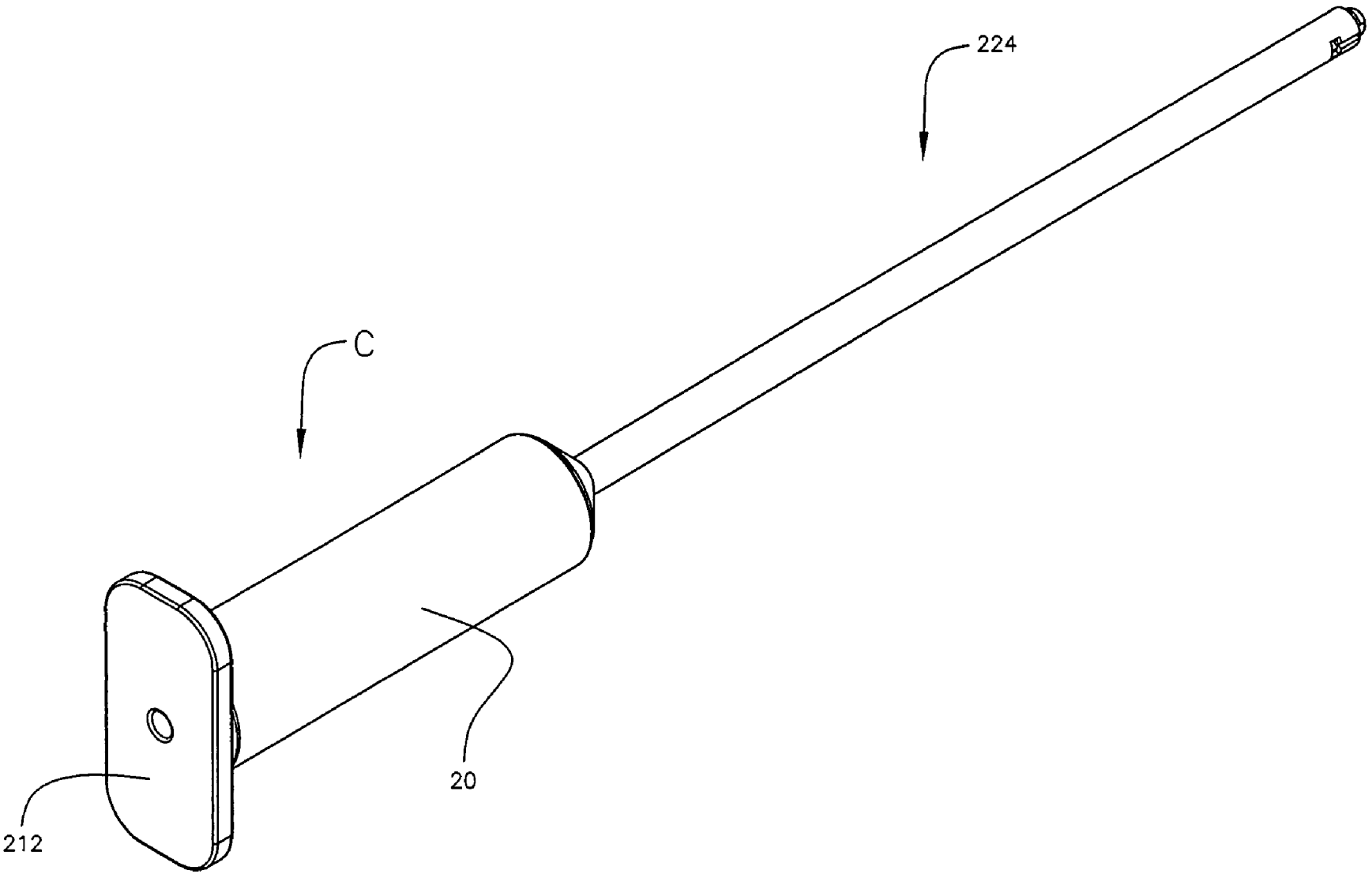
FIG. 13A is a perspective view of an adjustable barrel plug assembly having bore adjusting components mounted thereto.
Figure 13B:
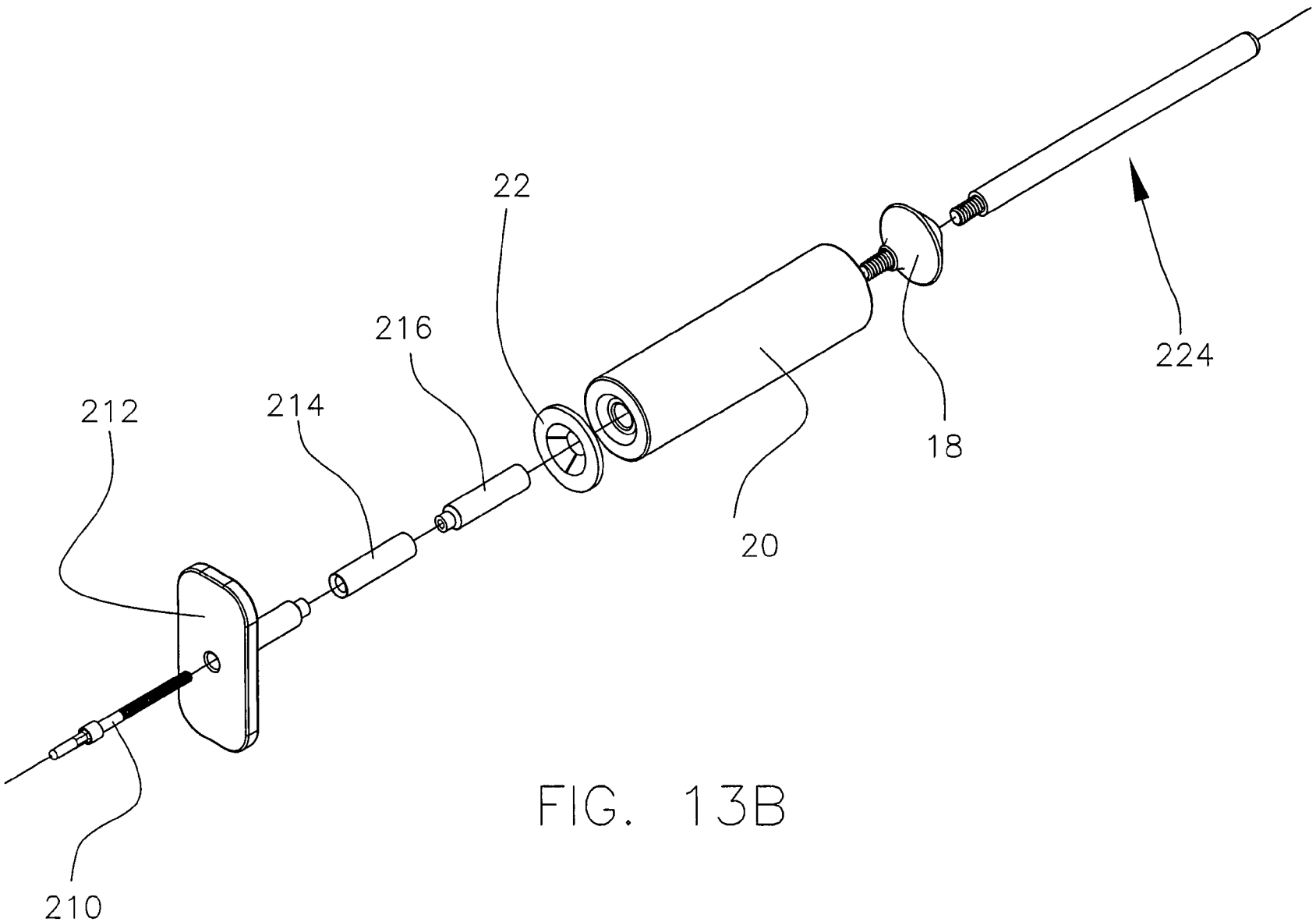
FIG. 13B is an exploded view of FIG. 13A.

With reference to FIGS. 13A and 13B, bore adjusting components C similar to those described above (i.e., one-way locking push nut 22, slide-on expansion tube 20 and screw-on expansion tube adapter 18) can also attach to the adjustable barrel plug assemblies described above. With such a configuration, both the barrel length and the caliber of the barrel plug assembly can be adjusted.

Figure 14A:
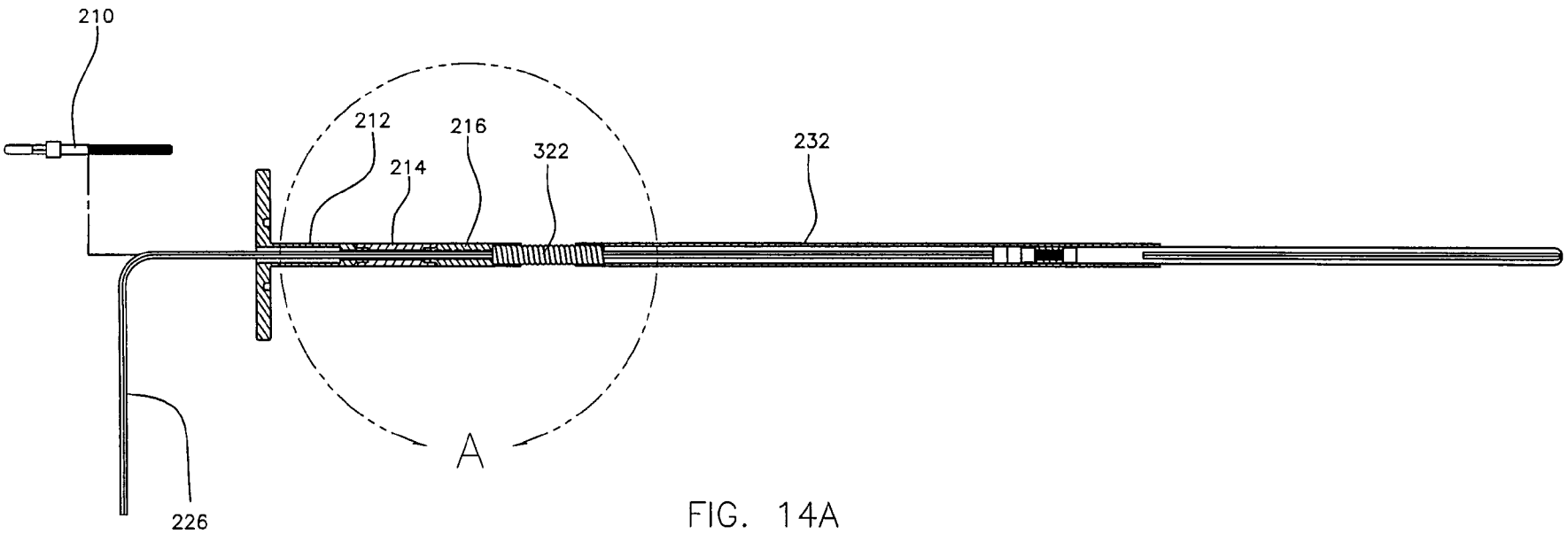
FIG. 14A is a partial cross-section of a barrel plug assembly including a flexible joint.
Figure 14B:
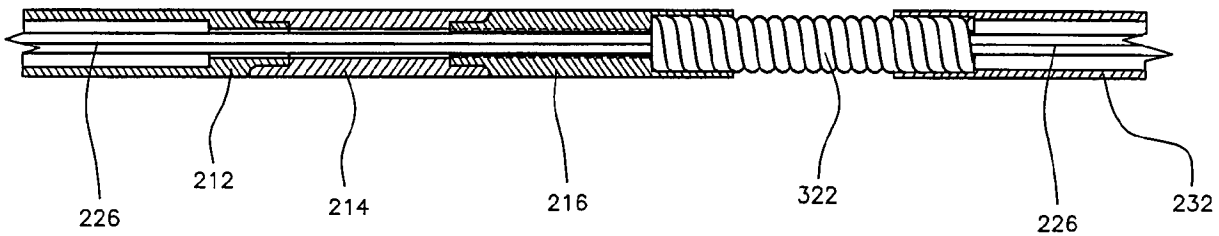
FIG. 14B is a close-up view of section A of FIG. 14A, (with some internal features being represented by a dashed line.)

With reference to FIGS. 14A and 14B, each of the abovementioned barrel plug assemblies can include a flexible joint 322. In the embodiment depicted, the flexible joint 322 comprises a spring that fits between the rear compression base 216 and the tubular plug extension 232. As seen, the flexible joint 322 is received in a female receptacle on the rear compression base 216 and the tubular plug extension 232. In alternative embodiments, the flexible joint can fit elsewhere on and in alternative manners to the assembly. The flexible joint protects the barrel plug assembly from being bent when not installed in a gun.

The invention has been described with reference to the preferred embodiments. However, certain modifications and alterations are contemplated. In one instance, it is contemplated that the wrench assembly B could be automated, for example, with a small battery operated DC reverse polarity motor. In another instance, it is contemplated that wrench assembly B and the barrel plug assembly A could be permanently joined, for example, by affixing the flange 12*b* to the lower handle mount 50 or by forming the flanged bolt-retaining plug 12 and the lower handle mount 50 as single piece. In either case, if the wrench assembly B was forcibly tampered with, the flange bolt retaining plugs' flange 12*b* (which is now joined to or part of the lower handle mount 50) would still break-away at gap 12*b*' leaving the rest of the plug assembly A securely installed in the guns' barrel. Obviously, other modifications and alterations will occur to others upon reading and understanding the preceding detailed description. It is intended that the invention be construed as including all such modifications and alterations insofar as they come within the scope of the appended claims or the equivalents thereof.

The invention claimed is:

1. A gun safety device comprising:

a barrel plug assembly having a first compression member, a second compression member, an expansion member sandwiched between the first compression member and the second compression member, a joining member operatively linking the first compression member to the second compression member, wherein the joining member is adapted to draw at least one of the compression members towards the other compression member, and an adjustable extension rod assembly extending from the second compression member, the adjustable extension rod assembly being configured to adjust the length of the device and including a tubular plug extension, a rod received in the tubular plug extension such that the rod can move with respect to the tubular plug extension, and an engagement mechanism that selectively engages a surface of the tubular extension to fix the location of the slidable rod in relation to the tubular plug extension.

2. The device of claim 1, wherein the tubular plug extension attaches to the second compression member.

3. The device of claim 1, wherein the adjustable rod assembly further comprises a sliding compression member, and the engagement mechanism includes a sliding expansion member received in the tubular plug extension, wherein the sliding expansion member is interposed between the rod and the sliding compression member.

4. The device of claim 3, wherein the sliding compression member and the rod are operatively connected to one another such that the at least one of the sliding compression member and the rod can be drawn toward the other to secure the rod in relation to the tubular plug extension.

5. The device of claim 3, further comprising an additional joining member operatively linking the sliding compression member to the rod, wherein the additional joining member is adapted to draw at least one of the sliding compression member and the rod towards the other.

6. The device of claim 1, further comprising an outer expansion tube that fits over the expansion member and an adapter disposed at or near an end of the outer expansion tube, wherein the adjustable extension rod assembly attaches to the adapter.

7. The device of claim 1, further comprising a flexible joint interposed between the tubular plug extension and the second compression member.

8. The device of claim 7, wherein the flexible joint comprises a spring.

9. The device of claim 1, wherein the engagement mechanism comprises an expandable portion on the sliding rod that selectively engages the tubular plug extension to fix the location of the sliding rod in relation to the tubular plug extension.

10. The device of claim 9, wherein the extension rod assembly further includes a wedge member received by the sliding rod to urge the expandable portion toward the tubular plug extension.

11. The device of claim 10, wherein the wedge member comprises a bolt having a tapered portion that cooperates with the expandable portion of the sliding rod to urge the expandable portion radially towards the tubular plug extension.

12. The device of claim 11, wherein the bolt is threadably received by the sliding rod.

13. The device of claim 10, further comprising a biasing member for biasing the wedge member, wherein the biasing member is received by the sliding rod.

14. The device of claim 9, wherein the tubular plug extension includes a plurality of inner notches adapted to selectively receive the expandable portion of the sliding rod.

15. The device of claim 1, wherein the engagement mechanism of the adjustable extension rod assembly further includes a releasable catch mechanism that engages both the tubular plug extension and the sliding rod to fix the location of the tubular plug extension in relation to the sliding rod.

16. The device of claim 15, wherein the releasable catch mechanism includes a plunger having a ramp, a biasing member operatively engaging the plunger and a ball riding on the ramp, wherein each of the plunger, the biasing member and the ball is received by the sliding rod.

17. A gun safety device comprising:

a barrel plug assembly including an adjustable rod assembly to adjust the length of the barrel plug assembly and a selectively expandable portion to selectively engage the barrel of an associated gun, wherein the adjustable rod assembly includes a tubular extension having an internal bore and a slidable rod received in the internal bore of the tubular extension, the tubular extension and the slidable rod cooperating with one another to allow selective movement of the rod in and out of the bore and to inhibit rotational movement of the rod in the bore, wherein the adjustable rod assembly includes an engagement mechanism attached to the slidable rod that selectively engages an inner surface of the tubular extension to fix the location of the slidable rod in relation to the tubular extension.

18. The device of claim 17, wherein the engagement mechanism includes a compression member, an expansion member and a joining member, wherein the expansion member is sandwiched between the compression member and the slidable rod and the joining member is adapted to draw at least one of the compression member and the slidable rod toward the other.

19. The device of claim 17, wherein the engagement mechanism is adapted to deform axially in response to a compressive force.

20. The device of claim 19, further comprising a compression member attached to the engagement mechanism such that the engagement mechanism is sandwiched between the compression member and the slidable rod.

21. The device of claim 20, further comprising a joining member operatively linking the compression member to the slidable rod.

22. The device of claim 17, wherein the tubular extension includes a plurality of notches dimensioned to receive the engagement mechanism.

23. The device of claim 17, wherein the slidable rod includes a slit formed in the slidable rod at an end adjacent the engagement mechanism, wherein the slit is substantially parallel to a longitudinal axis of the slidable rod.

24. The device of claim 23, further comprising a wedge member adapted to be received inside the engagement mechanism for selectively expanding the engagement mechanism.

25. The device of claim 17, wherein the engagement mechanism includes a releasable catch mechanism received in the slidable rod that selectively engages both the tubular extension and the slidable rod to fix the slidable rod in relation to the tubular extension.

26. The device of claim 17, further comprising a flexible joint interposed between the selectively expandable portion and the tubular extension.

27. The device of claim 17, wherein the tubular extension includes a tab and the rod includes a slot configured to receive the tab.

28. A gun safety device comprising:

a barrel plug assembly including an adjustable rod assembly to adjust the length of the barrel plug assembly and a first selectively expandable portion configured to selectively engage the barrel of an associated gun, the adjustable rod assembly including a tubular extension having an internal bore, a slidable rod received in the internal bore of the tubular extension and an engagement mechanism connected to the rod, the engagement mechanism including a member configured to selectively move radially to selectively engage an inner surface of the tubular extension.

29. The device of claim 28, wherein the member of the engagement mechanism comprises an expandable member configured to deform upon compression to engage the inner surface of the tubular extension.

30. The device of claim 28, wherein the member of the engagement mechanism comprises a flanged lip disposed adjacent a slit in the slidable rod.

31. The device of claim 28, wherein the member of the engagement mechanism comprises a ball.

* * * * *